US011118146B2

(12) United States Patent
Tan et al.

(10) Patent No.: US 11,118,146 B2
(45) Date of Patent: Sep. 14, 2021

(54) UNITARY LAUNDRY DETERGENT ARTICLE

(71) Applicant: The Procter & Gamble Company, Cincinnati, OH (US)

(72) Inventors: Hongsing Tan, Beijing (CN); Mark Robert Sivik, Cincinnati, OH (US); Frank William Denome, Cincinnati, OH (US); Carl David MacNamara, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 67 days.

(21) Appl. No.: 16/136,624

(22) Filed: Sep. 20, 2018

(65) Prior Publication Data

US 2019/0093057 A1 Mar. 28, 2019

(30) Foreign Application Priority Data

Sep. 25, 2017 (WO) ..... CN2017/103090

(51) Int. Cl.

| | |
|---|---|
| ***C11D 17/06*** | (2006.01) |
| ***C11D 1/37*** | (2006.01) |
| ***C11D 3/37*** | (2006.01) |
| ***C11D 11/00*** | (2006.01) |
| ***C11D 1/83*** | (2006.01) |
| *C11D 1/29* | (2006.01) |

(Continued)

(52) U.S. Cl.

CPC ..... *C11D 17/06* (2013.01); *C11D 1/37* (2013.01); *C11D 1/83* (2013.01); *C11D 3/3707* (2013.01); *C11D 3/3723* (2013.01); *C11D 3/3753* (2013.01); *C11D 11/0017* (2013.01); *C11D 1/146* (2013.01); *C11D 1/22* (2013.01); *C11D 1/29* (2013.01); *C11D 1/72* (2013.01)

(58) Field of Classification Search

CPC ..... C11D 13/06; C11D 1/37

See application file for complete search history.

(56) References Cited

U.S. PATENT DOCUMENTS 4,170,565 A 10/1979 Flesher et al.
4,557,852 A 12/1985 Schulz et al.

(Continued)

FOREIGN PATENT DOCUMENTS

CA 1242949 A 10/1988
CA 2347695 A1 * 5/2000 ..... C11D 3/38618

(Continued)

OTHER PUBLICATIONS

Search Report for application No. PCT/CN2017/103090, dated Jul. 3, 2018, 5 pages.

(Continued)

*Primary Examiner* — Liam J Heincer
*Assistant Examiner* — M. Reza Asdjodi
(74) *Attorney, Agent, or Firm* — Andres E. Velarde

(57) ABSTRACT

A unitary laundry detergent article that is completely or substantially water-soluble, which contains two or more non-fibrous, surfactant-containing sheets with one or more discrete, surfactant-containing particles located between such sheets. The non-fibrous sheets contain a first surfactant that is relatively less hydrophilic, while the discrete particles contain a second surfactant that is relatively more hydrophilic.

15 Claims, 6 Drawing Sheets

(51) Int. Cl.

| | |
|---|---|
| *C11D 1/14* | (2006.01) |
| *C11D 1/72* | (2006.01) |
| *C11D 1/22* | (2006.01) |

(56) References Cited

U.S. PATENT DOCUMENTS

| | | | | |
|---|---|---|---|---|
| 4,610,799 | A | 9/1986 | Wilsberg et al. | |
| 4,654,395 | A | 3/1987 | Schulz et al. | |
| 4,743,394 | A | 5/1988 | Kaufmann et al. | |
| 4,747,976 | A | 5/1988 | Yang et al. | |
| 4,806,261 | A | 2/1989 | Ciallella et al. | |
| 4,938,888 | A | 7/1990 | Kiefer et al. | |
| 5,202,045 | A | 4/1993 | Karpusiewicz et al. | |
| 5,389,425 | A | 2/1995 | Platt et al. | |
| 5,687,591 | A * | 11/1997 | Siklosi | C11D 17/047 34/330 |
| 6,818,606 | B1 * | 11/2004 | Hanada | C11D 11/02 510/296 |
| 6,936,330 | B2 * | 8/2005 | Fereshtehkhou | C11D 3/50 428/141 |
| 7,094,744 | B1 | 8/2006 | Kobayashi et al. | |
| 8,757,062 | B2 | 6/2014 | Content et al. | |
| 2002/0013251 | A1 * | 1/2002 | Hayashi | C11D 1/62 510/445 |
| 2002/0062574 | A1 * | 5/2002 | Volpenhein | C11D 3/222 34/108 |
| 2003/0064042 | A1 * | 4/2003 | Bergquist | A61K 8/02 424/70.1 |
| 2005/0266230 | A1 * | 12/2005 | Hill | A47L 13/16 428/317.9 |
| 2006/0205628 | A1 * | 9/2006 | Deinhammer | C11D 3/386 510/386 |
| 2006/0247148 | A1 * | 11/2006 | Ortiz | C11D 1/37 510/424 |
| 2008/0003906 | A1 | 1/2008 | Hill et al. | |
| 2011/0136719 | A1 | 6/2011 | Jalbert et al. | |
| 2012/0071382 | A1 * | 3/2012 | Wang | D06M 15/6436 510/222 |
| 2013/0172226 | A1 * | 7/2013 | Dreher | C11D 17/0039 510/220 |
| 2015/0159330 | A1 | 6/2015 | Weisman et al. | |
| 2015/0218497 | A1 | 8/2015 | Jalbert et al. | |
| 2016/0355767 | A1 * | 12/2016 | Souter | C11D 3/50 |
| 2017/0009191 | A1 * | 1/2017 | Maes | C11D 17/042 |
| 2017/0137745 | A1 * | 5/2017 | Tang | C11D 1/146 |
| 2017/0211018 | A1 * | 7/2017 | Dykstra | C11D 3/0015 |
| 2017/0234618 | A1 | 8/2017 | Guo | |
| 2018/0223225 | A1 * | 8/2018 | Tan | C11D 1/83 |
| 2019/0093057 | A1 * | 3/2019 | Tan | C11D 1/83 |
| 2019/0233779 | A1 * | 8/2019 | Tan | C11D 3/3753 |

FOREIGN PATENT DOCUMENTS

| | | | | |
|---|---|---|---|---|
| CN | 1202517 | | 12/1998 | |
| CN | 1202517 | A | 12/1998 | |
| CN | 2352536 | Y | 12/1999 | |
| CN | 125585 | A | 4/2000 | |
| CN | 102492573 | A | 6/2012 | |
| CN | 102492573 | U | 6/2012 | |
| CN | 102732392 | A | 10/2012 | |
| CN | 202744521 | | 2/2013 | |
| CN | 202744521 | U | 2/2013 | |
| CN | 202754982 | U | 2/2013 | |
| CN | 102965223 | A | 3/2013 | |
| CN | 202754982 | A | 3/2013 | |
| CN | 103740490 | A | 4/2014 | |
| CN | 105238584 | A | 1/2016 | |
| CN | 105462733 | A | 4/2016 | |
| CN | 105586165 | A | 5/2016 | |
| CN | 105647716 | A | 6/2016 | |
| CN | 105861168 | A | 8/2016 | |
| CN | 105886142 | A | 8/2016 | |
| CN | 205420320 | | 8/2016 | |
| CN | 205420320 | U | 8/2016 | |
| CN | 105199887 | A | 10/2018 | |
| EP | 0234867 | A2 | 9/1987 | |
| EP | 234867 | A3 | 9/1987 | |
| JP | 3008496 | A | 1/1988 | |
| JP | 63012466 | A | 1/1988 | |
| JP | S638496 | A | 1/1988 | |
| JP | S6312466 | A | 1/1988 | |
| JP | 63150396 | A | 6/1988 | |
| JP | S63150396 | A | 6/1988 | |
| JP | 04202600 | A | 7/1992 | |
| JP | H04202600 | A | 7/1992 | |
| JP | 4509284 | B2 | 7/2010 | |
| KR | 20090036882 | A | 4/2009 | |
| KR | 20090036883 | A | 4/2009 | |
| KR | 20100090122 | A | 8/2010 | |
| KR | 20100096985 | A | 9/2010 | |
| KR | 101146292 | B1 | 5/2012 | |
| KR | 20120127174 | A | 11/2012 | |
| KR | 20120130693 | A | 12/2012 | |
| KR | 20080111815 | A | 1/2013 | |
| WO | WO2008053381 | A1 | 5/2008 | |
| WO | WO-2008053381 | A1 * | 5/2008 | B65D 65/46 |
| WO | WO2012157851 | A1 | 11/2012 | |

OTHER PUBLICATIONS

International Search Report and Written Opinion; Application Ser. No. PCT/CN2018/074281; dated Jun. 27, 2018; 8 pages.

Supplementary International Search Report and Written Opinion; Application Ser. No. PCT/CN2018/074281; dated Aug. 29, 2019; 6 pages.

* cited by examiner

Position 1

Position 2

Position 3

UNITARY LAUNDRY DETERGENT ARTICLE

FIELD OF THE INVENTION

This invention relates to a unitary laundry detergent article that is water-soluble.

BACKGROUND OF THE INVENTION

Sheet-like laundry detergent articles that are completely or substantially soluble in water have been known in the art. They are easier to handle than both powder and liquid laundry detergents. In contrast with powder laundry detergents, which can easily be spilled during use or can absorb moisture from the ambient air to form clumps (i.e., caking), these laundry detergent sheets have an integral or unitary article that significantly lowers the risk of spillage or caking. Unlike liquid laundry detergent, these laundry detergent sheets contain little or no water. Consequently, they are extremely concentrated and are much easier to transport and handle, with little or no risk of leakage. Further, they are chemically and physically stable during shipment and storage, and have a significantly smaller physical and environmental footprint.

In recent years, these sheet-like laundry detergent articles have made significant progress in various aspects, including increased surfactant contents by employing polyvinyl alcohol (PVA) as the main film former and improved processing efficiency by employing a rotating drum drying process. Consequently, they have become more and more commercially available and popular among consumers.

However, such sheet-like laundry detergent articles still suffer from significant limitation on the types of surfactants that can be used, because only a handful of surfactants (such as alkyl sulfates) can be processed to form sheets on a rotating drum dryer. When other surfactants are incorporated into the sheet-like laundry detergent articles, the resulting articles may exhibit undesirable attributes (e.g., slow dissolution and undesired caking), and more importantly, the sheet-like articles may stick to the drum dryer during film-forming and need to be scraped off immediately, which can significantly disrupt the manufacturing process and reduce the processing stability. Such limited choice of surfactants that can be used in the sheet-like laundry detergent articles in turn leads to poor cleaning performances, especially in regions where fabrics or garments are exposed to a garden variety of soils that can only be effectively removed by different surfactants with complementary cleaning powers.

There is therefore a need for sheet-like laundry detergent articles with more freedom in the choice of surfactants and corresponding improved cleaning performance across a garden variety of soils, while at the same time maintaining the processing stability and other desirable attributes of the existing sheet-like laundry detergent articles, such as fast dissolution and little or no caking.

SUMMARY OF THE INVENTION

The present invention provides a unitary laundry detergent article that is water-soluble, which contains one or more discrete, surfactant-containing particles that are sandwiched between two or more non-fibrous, surfactant-containing sheets. Specifically, the non-fibrous sheets contain a first surfactant that is relatively less hydrophilic, while the discrete particles contain a second surfactant that is relatively more hydrophilic. Such a unitary laundry detergent article can be easily made by a particle-marking (e.g., granulation and/or spray-drying) process and a film-forming process, and its advantages include more freedom in the choice of surfactants, improved cleaning performance, processing stability, fast dissolution, and little or no caking.

In one aspect, the present invention relates to a unitary laundry detergent article comprising two or more non-fibrous sheets and one or more discrete particles disposed between such two or more non-fibrous sheets. Both such non-fibrous sheets and such discrete particles are water-soluble. Each of the non-fibrous sheets contains at least one film former and a first surfactant, while such first surfactant is characterized by a Hydrophilic Index (HI) of no more than about 7.5. The first surfactant can be selected, for example, from the group consisting of unalkoxylated $C_6$-$C_{20}$ linear or branched alkyl sulfates (AS), $C_6$-$C_{20}$ linear alkylbenzene sulfonates (LAS), and combinations thereof. Each of the discrete particles contains a second surfactant, while such second surfactant is characterized by a HI of greater than about 7.5. The second surfactant can be selected, for example, from the group consisting of $C_6$-$C_{20}$ linear or branched alkylalkoxylated sulfates (AAS) having a weight average degree of alkoxylation ranging from about 0.1 to about 10, $C_6$-$C_{20}$ alkylalkoxylated alcohols (AA) having a weight average degree of alkoxylation ranging from about 5 to about 15, and combinations thereof.

Each of the non-fibrous sheets preferably has a thickness ranging from about 0.1 mm to about 10 mm, more preferably a length-to-thickness aspect ratio of at least about 5:1, and most preferably a width-to-thickness aspect ratio of at least about 5:1.

The discrete particles may be characterized by a median particle size ranging from about 1 μm to about 2000 μm, preferably from about 100 μm to about 1500 μm, more preferably from about 250 μm to about 1000 μm.

Preferably, but not necessarily, the discrete particles are at least partially embedded into at least one of the above-mentioned non-fibrous sheets.

Preferably, the first surfactant and/or second surfactant are the main surfactants in each of the non-fibrous sheets and/or the discrete particles, respectively. The first surfactant is preferably an unalkoxylated $C_6$-$C_{18}$ linear or branched AS surfactant, more preferably an unalkoxylated $C_{12}$-$C_{14}$ linear or branched AS surfactant. The second surfactant is preferably a $C_6$-$C_{20}$ linear or branched AAS surfactant having a weight average degree of alkoxylation ranging from about 0.1 to about 10, more preferably a $C_{10}$-$C_{16}$ linear or branched alkylethoxylated sulfate (AES) having a weight average degree of alkoxylation ranging from about 1 to about 5.

In a particularly preferred embodiment of the present invention, each of the non-fibrous sheets contains: (1) from about 5% to about 90%, preferably from about 20% to about 90%, more preferably from about 30% to about 90%, most preferably from about 40% to about 90% of the first surfactant, by total weight of such each non-fibrous sheet; and preferably (2) from about 1% to about 70%, preferably from about 2% to about 60%, more preferably from about 5% to about 50%, most preferably from about 10% to about 40% of the above-mentioned at least one film former, by total weight of such each non-fibrous sheet. Optionally, each of the non-fibrous sheets may further comprise from 0% to 15%, preferably from 0% to 10%, more preferably from 0% to 5%, most preferably from 0% to 1% of the second surfactant, by total weight of such each non-fibrous sheet.

The at least one film former may be a water-soluble polymer selected from the group consisting of polyvinyl alcohols, polyalkylene glycols, starch or modified starch, cellulose or modified cellulose, polyacrylates, polymethacrylates, polyacrylamides, polyvinylpyrrolidones, and combinations thereof. More preferably, the water-soluble polymer is selected from the group consisting of polyvinyl alcohols, polyalkylene glycols, and combinations thereof.

Each of the discrete particles preferably contains from about 20% to about 90%, preferably from about 30% to about 90%, more preferably from about 40% to about 90%, most preferably from about 50% to about 90% of the above-mentioned second surfactant, by total weight of such each discrete particle. Optionally, each of the discrete particles may further comprise from 0% to 50%, preferably from 0% to 30%, more preferably from 0% to 20%, most preferably from 0% to 15% of the first surfactant, by total weight of such each discrete particle.

More preferably, when the second surfactant is AAS or AES, each of the discrete particles further comprises from about 0.5% to about 20%, preferably from about 1% to about 15%, more preferably from about 2% to about 10% of an alkoxylated polyalkyleneimine, by total weight of such each discrete particle. The alkoxylated polyalkyleneimine may have an empirical formula of $(PEI)_a(CH_2CH_2O)_b(CH_2CH_2CH_2O)_c$, in which PEI is a polyethyleneimine core; a is the number average molecular weight ($MW_n$) of the PEI core prior to modification, which ranges from about 100 to about 100,000 Daltons, preferably from about 200 to about 5000 Daltons, more preferably from about 500 to about 1000 Daltons; b is the weight average number of ethylene oxide ($CH_2CH_2O$) units per nitrogen atom in the PEI core, which ranges from 0 to about 60, preferably from about 1 to about 50, more preferably from about 5 to about 40, most preferably from about 10 to about 30; and c is the weight average number of propylene oxide ($CH_2CH_2CH_2O$) units per nitrogen atom in the PEI core, which ranges from 0 to about 60, preferably from 0 to about 40, more preferably from 0 to about 30, most preferably from 0 to about 20.

When the second surfactant is AAS or AES, each of the discrete particles may further comprise from about 0.5% to about 20%, preferably from about 1% to about 15%, more preferably from about 2% to about 10% of a polyalkylene glycol, by total weight of such each discrete particle. Preferably, the polyalkylene glycol is a polyethylene glycol with a weight average molecular weight ranging from 500 to 20,000 Daltons, preferably from about 1000 to 15,000 Daltons, and more preferably from 2000 to 8000 Daltons. More preferably, the polyalkylene glycol is present in each of said discrete particles together with the alkoxylated polyalkyleneimine as described hereinabove.

The unitary laundry detergent article of the present invention may further contain one or more fibrous sheets disposed in proximity to at least one of the above-mentioned non-fibrous sheets, while the one or more fibrous sheets are also water-soluble. Each of the one or more fibrous sheets preferably includes a plurality of filaments, and more preferably each of such filaments contains from about 10% to about 90%, preferably from about 20% to about 80%, more preferably from about 30% to about 70% of a third surfactant, by total dry weight of said each filament. Preferably, but not necessarily, the third surfactant is the same as the first surfactant.

In another aspect, the present invention relates to use of the unitary laundry detergent article as mentioned hereinabove for pre-treating and/or cleaning fabrics, for example, by wetting a section of the fabrics in need of pre-treating and/or cleaning, and directly contacting at least a portion of the unitary laundry detergent article with the wetted section of the fabrics.

These and other aspects of the present invention will become more apparent upon reading the following detailed description of the invention.

DETAILED DESCRIPTION OF THE INVENTION

Figure 1:
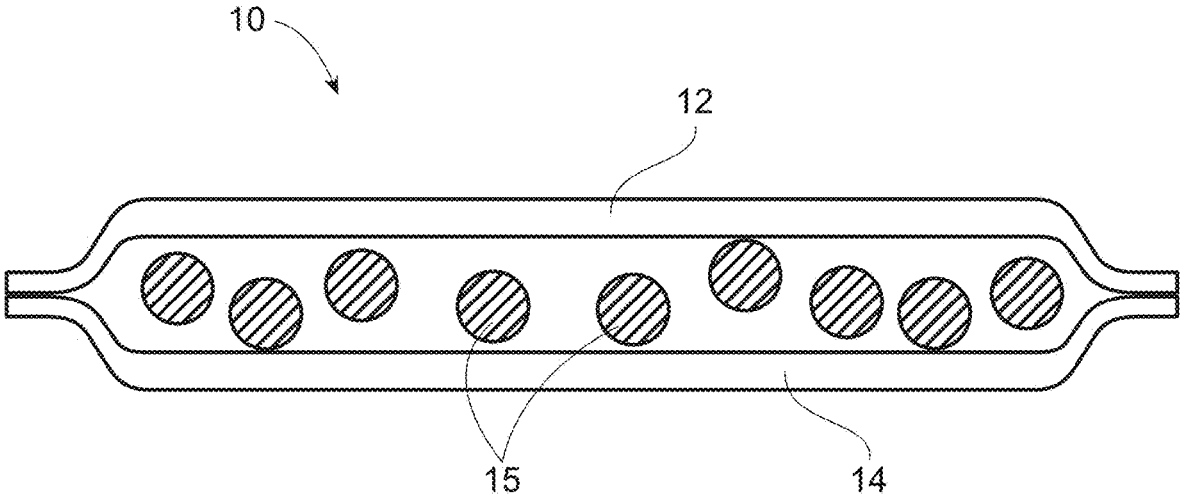
FIG. 1 is a schematic cross-sectional view of a unitary laundry detergent article comprising discrete, surfactant-containing particles sandwiched between two non-fibrous, surfactant-containing sheets, while the particles are free-flowing, according to one embodiment of the present invention.

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

As used herein, articles such as "a" and "an" when used in a claim, are understood to mean one or more of what is claimed or described. The terms "comprise," "comprises,"

"comprising," "contain," "contains," "containing," "include," "includes" and "including" are all meant to be non-limiting.

As used herein, the term "unitary" refers to a structure containing a plurality of distinctive parts that are combined together to form a visually coherent and structurally integral article.

As used herein, the term "non-fibrous" refers to a structure that is free of or substantially free of fibrous elements. "Fibrous element" and "filaments" are used interchangeably here to refer to elongated particles having a length greatly exceeding its average cross-sectional diameter, i.e., a length-to-diameter aspect ratio of at least 10:1, and preferably such elongated particles have an average cross-sectional diameter of no more than 1 mm.

As used herein, the term "sheet" refers to a three-dimensional shape having a thickness, a length, and a width, while the length-to-thickness aspect ratio and the width-to-thickness aspect ratio are both at least about 5:1, and the length-to-width aspect ratio is at least about 1:1. Preferably, the length-to-thickness aspect ratio and the width-to-thickness aspect ratio are both at least about 10:1, and the length-to-width aspect ratio is at least about 1.2:1. More preferably, the length-to-thickness aspect ratio and the width-to-thickness aspect ratio are both at least about 15:1, and the length-to-width aspect ratio is at least about 1.5:1. Most preferably, the length-to-thickness aspect ratio and the width-to-thickness aspect ratio are both at least about 20:1, and the length-to-width aspect ratio is at least about 1.618:1.

As used herein, the term "discrete" refers to particles that are structurally distinctive from each other either under naked human eyes or under electronic imaging devices, such as scanning electron microscope (SEM) and transmission electron microscope (TEM). Preferably, the discrete particles of the present invention are structurally distinctive from each other under naked human eyes.

As used herein, the term "particle" refers to a solid matter of minute quantity, such as a powder, granule, encapsulate, microcapsule, and/or prill. The particles of the present invention can be spheres, rods, plates, tubes, squares, rectangles, discs, stars or flakes of regular or irregular shapes, but they are non-fibrous. The particles of the present invention may have a median particle size of 2000 μm or less, as measured according to the Median Particle Size Test described herein. Preferably, the particles of the present invention have a median particle size ranging from about 1 μm to about 2000 μm, more preferably from about 10 μm to about 1800 μm, still more preferably from about 50 μm to about 1700 μm, still more preferably from about 100 μm to about 1500 μm, still more preferably from about 250 μm to about 1000 μm, most preferably from about 300 μm to about 800 μm, as measured according to the Median Particle Size Test described herein.

As used herein, the term "water-soluble" refers to the ability of a sample material to completely dissolve in or disperse into water leaving no visible solids or forming no visibly separate phase, when at least about 25 grams, preferably at least about 50 grams, more preferably at least about 100 grams, most preferably at least about 150 grams, of such material is placed in one liter (1 L) of deionized water at 20° C. and under the atmospheric pressure with sufficient stirring.

As used herein, the term "Percentage (%) Dissolved" refers to the ability of a sample material to dissolve within a specific time in the Black Cotton Pouch Dissolution Test described hereinafter. The Percentage (%) Dissolved of the sample material can be calculated as $$\frac{\text{Total Weight of Sample Material} - \text{Weight of Undissolved Solids}}{\text{Total Weight of Sample Material}} \times 100\%.$$

The higher this percentage, the better dissolution is the sample material within the specified time. It is possible for this rate to be negative if the undissolved solids retain enough moisture after drying.

As used herein, "Hydrophilic Index" or "HI" of a surfactant is calculated by the following equation:

$$HI = \frac{M_h}{M_T} \times 20$$

wherein $M_h$ is the molecular weight of all hydrophilic groups in the surfactant, wherein $M_T$ is the total molecular weight of the surfactant. Both $M_h$ and $M_T$ refer to weight average molecular weights. For example, linear alkylbenzene sulfonate with an average alkyl chain length of about 11.8 has a HI value of about 4.97. For another example, $C_{12}$-$C_{14}$ alkyl sulfate has a HI value of about 6.98. For yet another example, $C_{12}$-$C_{14}$ alkylethoxylated sulfate with an average ethoxylation degree of about 1 has a HI value of about 8.78, and $C_{12}$-$C_{14}$ alkylethoxylated sulfate with an average ethoxylation degree of about 3 has a HI value of about 11.57. For still another example, $C_{14}$-$C_{15}$ alkylethoxylated alcohol with an average ethoxylation degree of about 7 has a HI value of about 12.73, and $C_{12}$-$C_{14}$ alkylethoxylated alcohol with an average ethoxylation degree of about 9 has a HI value of about 14.72.

As used herein, the term "main surfactant" refers to a surfactant which is present in an article at an amount of 50% or more, by total weight of all surfactants in such article.

As used herein, the terms "consisting essentially of" means that the composition contains no ingredient that will interfere with benefits or functions of those ingredients that are explicitly disclosed. Further, the term "substantially free of" or "substantially free from" means that the indicated material is present in the amount of from 0 wt % to about 5 wt %, preferably from 0 wt % to 3 wt %. The term "essentially free of" means that the indicated material is present in the amount of from 0 wt % to about 1 wt %, preferably from 0 wt % to about 0.5 wt %, more preferably from 0 wt % to about 0.1 wt %, most preferably it is not present at analytically detectable levels.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are determined by weight average number molecular weight unless otherwise specifically noted.

Non-Fibrous Sheets

The non-fibrous sheets used for holding or containing the discrete particles in the unitary laundry detergent article of the present invention are water-soluble. In other words, they do not contain any water-insoluble substrate, as some of the conventional laundry detergent sheets do.

Each of such non-fibrous sheets contain at least one film former and a first surfactant. The first surfactant has a relatively low hydrophilicity (in comparison with the second surfactant contained by the discrete particles) and is characterized by a Hydrophilic Index (HI) of no more than 7.5. Such a first surfactant is less likely to form a viscous, gel-like hexagonal phase while being diluted, in comparison with the second surfactant. Therefore, by using such a first surfactant in forming the non-fibrous sheets rather than the discrete particles, the present invention can effectively reduce gel-formation during wash, which in turn leads to fast dissolution and low or no undissolvable residues of the resulting unitary laundry detergent structure.

The non-fibrous sheets can have any shape or size, so long as its thickness, its length, and its width are characterized by: (1) a length-to-thickness aspect ratio of at least about 5:1, (2) a width-to-thickness aspect ratio of at least about 5:1, and (3) a length-to-width aspect ratio of at least about 1:1. All the ensuing size- and/or shape-related parameters for the unitary laundry detergent article also apply to each of the non-fibrous sheets.

Each of the non-fibrous sheets are characterized by a sufficiently high total surfactant content, e.g., at least about 30%, preferably at least about 40%, more preferably at least about 50%, more preferably at least about 60%, and most preferably at least about 70%, by total weight of such sheet.

Preferably, the first surfactant as mentioned hereinabove is the main surfactant in each of the non-fibrous sheets, i.e., it is present at an amount of about 50% or more, by total weight of all surfactants in such non-fibrous sheet. The first surfactant is characterized by a HI of no more than about 7.5, and preferably from about 4 to 7.5, and more preferably from 4.5 to 7.

Suitable surfactants for use as the first surfactant in the present invention include unalkoxylated $C_6$-$C_{20}$ linear or branched alkyl sulfates (AS), $C_6$-$C_{20}$ linear alkylbenzene sulfonates (LAS), and combinations thereof. A particularly preferred type of surfactants for use as the first surfactant in the non-fibrous sheets of the present invention are unalkoxylated $C_6$-$C_{18}$ AS, which are referred to as "mid-cut AS" hereinafter, while each of which has a branched or linear unalkoxylated alkyl group containing from about 6 to about 18 carbon atoms. In a particularly preferred embodiment of the present invention, the mid-cut AS is present as the main surfactant in the non-fibrous sheet, i.e., it is present in an amount that is at least about 50% by total weight of all surfactants in the non-fibrous sheet, while another surfactant, such as LAS, are present as a co-surfactant.

The mid-cut AS of the present invention has the generic formula of $R—O—SO_3^-M^+$, while R is branched or linear unalkoxylated $C_6$-$C_{18}$ alkyl group, and M is a cation of alkali metal, alkaline earth metal or ammonium. Preferably, the R group of the AS surfactant contains from about 8 to about 16 carbon atoms, more preferably from about 10 to about 14 carbon atoms, and most preferably from about 12 to about 14 carbon atoms. R can be substituted or unsubstituted, and is preferably unsubstituted. R is substantially free of any alkoxylation. M is preferably a cationic of sodium, potassium, or magnesium, and more preferably M is a sodium cation.

The amount of mid-cut AS surfactants used in the present invention may range from about 5% to about 90%, preferably from about 10% to about 80%, more preferably from about 20% to about 75%, and most preferably from about 30% to about 70%, by total weight of the non-fibrous sheets. Such mid-cut AS surfactant(s) preferably functions as the main surfactant in the surfactant system of the non-fibrous sheets. In other words, the mid-cut AS surfactant(s) are present in an amount of greater than 50% by total weight of all surfactants in the non-fibrous sheets.

Preferably, the surfactant system of the non-fibrous sheets may contain a mixture of mid-cut AS surfactants comprising more than about 50 wt %, preferably more than about 60 wt %, more preferably more than 70 wt % or 80 wt %, and most preferably more than 90 wt % or even at 100 wt % (i.e., substantially pure), of linear AS surfactants having an even number of carbon atoms, including, for example, $C_6$, $C_8$, $C_{10}$, $C_{12}$, $C_{14}$, $C_{16}$, and $C_{18}$ AS surfactants.

More preferably, the surfactant system of the non-fibrous sheets contains a mixture of mid-cut AS surfactants, in which $C_6$-$C_{14}$ AS surfactants are present in an amount ranging from about 85% to about 100% by total weight of the mixture. This mixture can be referred to as a "$C_6$-$C_{14}$-rich AS mixture." More preferably, such $C_6$-$C_{14}$-rich AS mixture contains from about 90 wt % to about 100 wt %, or from 92 wt % to about 98 wt %, or from about 94 wt % to about 96 wt %, or 100 wt % (i.e., pure), of $C_6$-$C_{14}$ AS.

In a particularly preferred embodiment of the present invention, the surfactant system contains a mixture of mid-cut AS surfactants comprising from about 30 wt % to about 100 wt % or from about 50 wt % to about 99 wt %, preferably from about 60 wt % to about 95 wt %, more preferably from about 65 wt % to about 90 wt %, and most preferably from about 70 wt % to about 80 wt % of $C_{12}$-$C_{14}$ AS, which can be referred to as a "$C_{12}$-$C_{14}$-rich AS mixture." Preferably, such $C_{12}$-$C_{14}$-rich AS mixture contains a majority of $C_{12}$ AS. In a most preferred embodiment of the present invention, the surfactant system contains a mixture of mid-cut AS surfactants that consist of $C_{12}$ and/or $C_{14}$ AS surfactants, e.g., 100% $C_{12}$ AS or from about 70 wt % to about 80 wt % of $C_{12}$ AS and from 20 wt % to about 30 wt % of $C_{14}$ AS, with little or no other AS surfactants therein.

In a most preferred embodiment of the present invention, each of the non-fibrous sheets contains from about 10 wt % to about 70 wt %, preferably from about 20 wt % to about 60 wt %, of pure $C_{12}$ AS or a $C_{12}$-$C_{14}$-rich AS mixture by total weight of such sheet, while the $C_{12}$-$C_{14}$-rich AS mixture contains from about 70 wt % to about 80 wt % of $C_{12}$ AS and from 20 wt % to about 30 wt % of $C_{14}$ AS by total weight of such mixture.

A commercially available mid-cut AS mixture particularly suitable for practice of the present invention is Texapon® V95 G from Cognis (Monheim, Germany).

Another preferred type of surfactants for use as the first surfactant in the non-fibrous sheets of the present invention are $C_6$-$C_{20}$ linear alkylbenzene sulfonates (LAS), which may be present in the non-fibrous sheets either alone or in combination with the mid-cut AS described hereinabove. LAS can either be present as a main surfactant, or as a co-surfactant for the mid-cut AS, in the non-fibrous sheets. In a particularly preferred embodiment of the present invention, LAS is present in the non-fibrous sheets as a co-surfactant for the mid-cut AS, for example, in a weight ratio ranging from 1:15 to 1:2, preferably from 1:10 to 1:3, and more preferably from 1:8 to 1:4.

LAS surfactants are well known in the art and can be readily obtained by sulfonating commercially available linear alkylbenzenes. Exemplary $C_6$-$C_{20}$ linear alkylbenzene sulfonates that can be used in the present invention include alkali metal, alkaline earth metal or ammonium salts of $C_6$-$C_{20}$ linear alkylbenzene sulfonic acids, and preferably the sodium, potassium, magnesium and/or ammonium salts of $C_{11}$-$C_{18}$ or $C_{11}$-$C_{14}$ linear alkylbenzene sulfonic acids. More preferred are the sodium or potassium salts of $C_{12}$ linear alkylbenzene sulfonic acids, and most preferred is the sodium salt of $C_{12}$ linear alkylbenzene sulfonic acid, i.e., sodium dodecylbenzene sulfonate. If present, the amount of LAS in the non-fibrous sheets may range from about 1% to about 90%, preferably from about 2% to about 70%, and more preferably from about 5% to about 40%, by total weight of the non-fibrous sheets. In a most preferred embodiment of the present invention, each of the non-fibrous sheets contains from about 5% to about 20% of a sodium, potassium, or magnesium salt of $C_{12}$ linear alkylbenzene sulfonic acid, by total weight of such non-fibrous sheet.

The non-fibrous sheets may each comprise at least one additional surfactant selected from the group consisting of other anionic surfactants (i.e., other than AS and LAS), nonionic surfactants, zwitterionic surfactants, amphoteric surfactants, cationic surfactants, and combinations thereof.

Other anionic surfactants suitable for inclusion into the non-fibrous sheets of the present invention include $C_6$-$C_{20}$ linear or branched alkyl sulfonates, $C_6$-$C_{20}$ linear or branched alkyl carboxylates, $C_6$-$C_{20}$ linear or branched alkyl phosphates, $C_6$-$C_{20}$ linear or branched alkyl phosphonates, $C_6$-$C_{20}$ alkyl N-methyl glucose amides, $C_6$-$C_{20}$ methyl ester sulfonates (MES), and combinations thereof.

Suitable nonionic surfactants include alkoxylated fatty alcohols. The nonionic surfactant may be selected from ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. Non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, BAE, wherein x is from 1 to 30; alkylpolysaccharides; specifically alkylpolyglycosides; polyhydroxy fatty acid amides; and ether capped poly(oxyalkylated) alcohol surfactants. Suitable nonionic detersive surfactants also include alkyl polyglucoside and alkyl alkoxylated alcohol. Suitable nonionic surfactants also include those sold under the tradename Lutensol® from BASF.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA). Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable examples of zwitterionic surfactants include: derivatives of secondary and tertiary amines, including derivatives of heterocyclic secondary and tertiary amines; derivatives of quaternary ammonium, quaternary phosphonium or tertiary sulfonium compounds; betaines, including alkyl dimethyl betaine, cocodimethyl amidopropyl betaine, and sulfo and hydroxy betaines; $C_8$ to $C_{18}$ (preferably from $C_{12}$ to $C_{18}$) amine oxides; N-alkyl-N,N-dimethylammino-1-propane sulfonate, where the alkyl group can be $C_8$ to $C_{18}$.

Suitable amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Suitable amphoteric surfactants also include sarcosinates, glycinates, taurinates, and mixtures thereof.

In a particularly preferred but not necessary embodiment of the present invention, the non-fibrous sheet may have a surfactant system containing only anionic surfactants, e.g., either a single anionic surfactant or a combination of two or more different anionic surfactants. Alternatively, the non-fibrous sheet may include a composite surfactant system, e.g., containing a combination of one or more anionic surfactants with one or more nonionic surfactants, or a combination of one or more anionic surfactants with one or more zwitterionic surfactants, or a combination of one or more anionic surfactants with one or more amphoteric surfactants, or a combination of one or more anionic surfactants with one or more cationic surfactants, or a combination of all the above-mentioned types of surfactants (i.e., anionic, nonionic, amphoteric and cationic).

Particularly, each of the non-fibrous sheets may comprise a small amount of surfactant(s) with a relatively high hydrophilicity (in comparison with the first surfactant mentioned hereinabove) characterized by a Hydrophilic Index (HI) of more than 7.5, i.e., the second surfactant(s) as described hereinafter. The amount of such second surfactant in each of the non-fibrous sheet is sufficiently small so as not to affect the processing stability and film dissolution thereof, e.g., from 0% to 15%, preferably from 0% to 10%, more preferably from 0% to 5%, most preferably from 0% to 1% by total weight of such each non-fibrous sheet. In a preferred embodiment of the present invention, each of the non-fibrous sheets is substantially free of, more preferably essentially free of, alkylalkoxylated sulfates, which are preferred choices for the second surfactant of the present invention. Alkylakoxylated sulfates, when dissolved in water, may undergo a highly viscous hexagonal phase at certain concentration ranges, e.g., 30-60% by weight, resulting in a gel-like substance. Therefore, if incorporated into the non-fibrous sheets in a significant amount, alkylalkoxylated sulfates may significantly slow down the dissolution of such sheets in water, and worse yet, resulting in undissolved solids afterwards. Correspondingly, the present invention formulates most of such surfactants into the discrete particles in the middle, instead of the non-fibrous sheets on both sides, which helps to minimize gel-formation by such surfactants, as well as reducing the impact of such gel-formation on dissolution of other ingredients in the unitary laundry detergent article of the present invention.

In addition to the surfactant(s) described hereinabove, each of the non-fibrous sheets contains at least one film former. Such at least one film former can be selected from water-soluble polymers, either synthetic or natural in origin and may be chemically and/or physically modified.

Suitable examples of water-soluble polymers for the practice of the present invention include polyvinyl alcohols, polyalkylene glycols (also referred to as polyalkylene oxides or polyoxyalkylenes), polysaccharides (such as starch or modified starch, cellulose or modified cellulose, pullulan, xanthum gum, guar gum, and carrageenan), polyacrylates, polymethacrylates, polyacrylamides, polyvinylpyrrolidones, and proteins/polypeptides or hydrolyzed products thereof (such as collagen and gelatin). Preferably, the film former to be used in the present invention is selected from the group consisting of polyvinyl alcohols, polyalkylene glycols, starch or modified starch, cellulose or modified cellulose, and combinations thereof. In a particularly preferred embodiment of the present invention, the non-fibrous laundry detergent sheet contains polyvinyl alcohol.

In the execution of polyvinyl alcohol (PVA), it may be unmodified or modified, e.g., carboxylated or sulfonated, or it may be a copolymer of vinyl alcohol or vinyl ester monomer with one or more other monomers. Preferably, the PVA is partially or fully alcoholised or hydrolysed. For example, it may be from about 40% to 100%, preferably from about 50% to about 95%, more preferably from about 70% to about 92%, alcoholised or hydrolysed. The degree of hydrolysis is known to influence the temperature at which the PVA starts to dissolve in water, e.g., 88% hydrolysis corresponds to a PVA film soluble in cold (i.e. room temperature) water, whereas 92% hydrolysis corresponds to a PVA film soluble in warm water. The weight average molecular weight of PVA may range from 10,000 to 140,000 Daltons, preferably from 15,000 to 120,000 Daltons. An example of preferred PVA is ethoxylated PVA. A more preferred example of PVA is commercially available from Sekisui Specialty Chemicals America, LLC (Dallas, Tex.) under the tradename CELVOL®. Another more preferred example of PVA is the so-called G Polymer commercially available Nippon Ghosei.

In the execution of polyalkylene glycols, preferably polyethylene glycols (PEG), they may be selected from poly (ethylene glycol) homopolymers and poly(ethylene glycol) copolymers having a weight average molecular weight of between about 200 and about 100,000 Daltons, preferably between about 500 and about 20,000 Daltons, more preferably from about 1000 to 15,000 Daltons, and most preferably from 2000 to 8000 Daltons. Suitable poly(ethylene glycol) copolymers preferably contain at least about 50 wt % of PEG and may be selected from the group consisting of poly(lactide-block-ethylene glycol), poly(glycolide-block-ethylene glycol), poly(lactide-co-caprolactone)-block-poly (ethylene glycol), poly(ethylene glycol-co-lactic acid), poly (ethylene glycol-co-glycolic acid), poly(ethylene glycol-co-poly(lactic acid-co-glycolic acid), poly(ethylene glycol-co-propylene glycol), poly(ethylene oxide-block-propylene oxide-block-ethylene oxide), poly(propylene oxide-block-ethylene glycol-block-propylene glycol), and poly(ethylene glycol-co-caprolactone). Exemplary poly(ethylene glycol) homopolymers are commercially available from Sigma Aldrich, or from Dow under the tradename of CARBOWAX™, or from BASF under the tradename of Pluriol®. Exemplary poly(ethylene glycol) copolymers are commercially available from BASF under the tradenames of Pluronic® F127, Pluronic® F108, Pluronic® F68 and Pluronic® P105, which contain propylene oxide (PO) blocks and ethylene oxide (EO) blocks. A particularly preferred PEG for the practice of the present invention is a poly(ethylene glycol) homopolymer having a weight average molecular weight of between about 4000 and about 8000 Daltons.

The film former may be present in the non-fibrous sheets of the present invention at from about 1% to about 70%, preferably from about 2% to about 60%, more preferably from about 5% to about 50%, and most preferably from about 10% to about 40%, by total weight of the non-fibrous sheets. In a particularly preferred embodiment of the present invention, each of the non-fibrous sheets contains both PVA and PEG, preferably at a weight ratio ranging from about 20:1 to about 1:2 ratio, more preferably from about 15:1 to about 1:1, most preferably from about 10:1 to about 2:1. For example, PVA may be present in the amount ranging from about 10% to about 40%, preferably from 15% to about 30%, and PEG may be present in the amount ranging from about 2% to about 20%, preferably from 5% to 10%, by total weight of such each non-fibrous sheet.

In addition to the film former, the non-fibrous sheets may also comprise suitable additives such as plasticizers and solids, for modifying the properties of the film former. Suitable plasticizers are, for example, pentaerythritols such as dipentaerythritol, sorbitol, mannitol, glycerine and glycols such as glycerol or ethylene glycol. Plasticizers are generally used in an amount of up to 30 wt %, for example from 0.1 to 20 wt %, preferably from 0.5 to 15 wt %, more preferably from 1 to 5 wt %. Solids such as zeolites, talc, stearic acid, magnesium stearate, silicon dioxide, zinc stearate or colloidal silica may also be used, generally in an amount ranging from about 0.5 to 5 wt %.

The non-fibrous sheets of the present invention may optionally include one or more other adjunct detergent ingredients for assisting or enhancing cleaning performance, or to modify the aesthetics of the sheet. Illustrative examples of such adjunct detergent ingredients include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylenepentamine); (4) polymeric dispersing agents, such as polymeric polycarboxylates and polyethylene glycols, acrylic/maleic-based copolymers and water-soluble salts thereof of, hydroxypropylacrylate, maleic/acrylic/vinyl alcohol terpolymers, polyethylene glycol (PEG), polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e.g., amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl) oxybenzenesulfonate, and mixtures thereof, benzoxazin-type activators, acyl lactam activators (especially acyl caprolactams and acyl valerolactams); and (14) any other known detergent adjunct ingredients, including but not limited to carriers, hydrotropes, processing aids, dyes or pigments (especially hueing dyes), perfumes (including both neat perfumes and perfume microcapsules), and solid fillers.

The non-fibrous sheets can be made by any suitable film-forming method, such as casting, molding, pressing, extrusion/extrusion-coating, calendar rolling, solution deposition, skiving, and lamination. In one specific embodiment, they can be formed by first providing a slurry containing raw materials dissolved or dispersed in water, and then shaping the slurry into a sheet-like form, e.g., by either pouring such slurry into a shallow mold or coating it over a heated rotatable cylinder. Drying of the sheet-like form can be carried out either simultaneously with the shaping step, or subsequently, to remove water and form finished sheets with little or no moisture content (e.g., less than 3 wt % water).

A preferred but non-limiting process for making the non-fibrous sheets of the present invention is by using a cylinder sheet production system, as described hereinafter. The cylinder sheet production system comprises a base bracket with a heated rotatable cylinder installed thereon. The heated rotatable cylinder can be driven by a motorized drive installed on the base bracket, and work at a predetermined rotation speed. Said heated rotatable cylinder is preferably coated with a non-stick coating on its outer surface.

There is also provided a feeding mechanism on the base bracket, which is for adding a pre-formed slurry containing all or some raw materials described hereinabove (e.g., the surfactant(s), the film former(s), and adjunct detergent ingredients) onto the heated rotatable cylinder. The feeding mechanism includes a feeding rack installed on the base bracket, while said feeding rack has installed thereupon at least one (preferably two) feeding hopper(s), an imaging device for dynamic observation of the feeding, and an adjustment device for adjusting the position and inclination angle of the feeding hopper.

There is also a heating shield installed on the base bracket, to prevent rapid heat lost. Otherwise, the slurry can solidify too quickly on the heated rotatable cylinder. The heating shield can also effectively save energy needed by the heated rotatable cylinder, thereby achieving reduced energy consumption and provide cost savings. The heating shield is a modular assembly structure, or integrated structure, and can be freely detached from the base bracket. A suction device is also installed on the heating shield for sucking the hot steam, to avoid any water condensate falling on the laundry detergent sheet that is being formed. There is also a start feeding mechanism installed on the base bracket, which is for scooping up the laundry detergent sheet already formed by the heated rotatable cylinder.

The making process of the non-fibrous sheets is as follows. Firstly, the heated rotatable cylinder with the non-stick coating on the base bracket is driven by the motorized drive. Next, the adjustment device adjusts the feeding mechanism so that the distance between the feeding hopper and the outer surface of the heated rotatable cylinder reaches a preset value. Meanwhile, the feeding hopper adds the pre-formed slurry containing all or some raw materials for making the non-fibrous sheets onto the heated rotatable cylinder. The suction device of the heating shield sucks the hot steam generated by the heated rotatable cylinder.

Next, the start feeding mechanism scoops up the dried sheets, which can then be sliced or cut into desired sizes by a slicing/cutting device downstream of the heated rotatable cylinder. Optionally, each sheet is further embossed with lines, patterns, logos, etc. by an embossing device downstream of the heated rotatable cylinder.

Discrete Particles

The discrete particles, which are sandwiched between the above-described non-fibrous sheets, are also water-soluble. Each of such discrete particles contains a second surfactant having a relatively high hydrophilicity (in comparison with the first surfactant contained by the non-fibrous sheets described hereinabove) and is characterized by a Hydrophilic Index (HI) of greater than 7.5. Due to its high HI value, the second surfactant is very effective in cleaning fabrics and removing stains, so it is desirable to include it into the unitary laundry detergent article of the present invention. However, such second surfactant of higher hydrophilicity may form a viscous, gel-like hexagonal phase while being dissolved in water. It is therefore difficult to formulate the second surfactant into the above-mentioned non-fibrous sheets, because the viscous hexagonal phase formed by the second surfactant will cause the sheets to stick to the rotatory drum dryer during the drying step and thereby adversely affect processing stability of the sheet formation. By formulating the second surfactant into discrete particles sandwiched between the non-fibrous sheets, such processing challenges can be readily avoided. Further, because the viscous hexagonal phase formed by the second surfactant may slow down dissolution of the non-fibrous sheets in water during use, it is also helpful to formulate the second surfactant into discrete particles that can be easily dispersed in water (rather than into the non-fibrous sheets that cannot), which improves overall dissolution of the unitary laundry detergent article during wash.

It is preferred that the discrete particles of the present invention have a relatively low water/moisture content (e.g., no more than about 10 wt % of total water/moisture, preferably no more than about 8 wt % of total water/moisture, more preferably no more than about 5 wt % of total moisture), especially a relatively low free/unbound water content (e.g., no more than about 3 wt % of free or unbound water, preferably no more than about 1 wt % of free or unbound water), so that water from such discrete particles will not compromise structural integrity of adjacent non-fibrous sheets. Further, the controlled moisture content in such discrete particles reduces the risk of gelling in the particles themselves. The water/moisture content present in a particle and/or substrate structure is measured using the following Water Content Test Method.

Discrete particles suitable for use in the present invention can be any shapes selected from the group consisting of spheres, rods, plates, tubes, squares, rectangles, discs, stars, flakes of regular or irregular shapes, and combinations thereof, as long as they are non-fibrous. They may have a median particle size of 2000 μm or less, as measured according to the Median Particle Size Test described herein. Preferably, such discrete particles have a median particle size ranging from about 1 μm to about 2000 μm, preferably from about 10 μm to about 1800 μm, more preferably from about 50 μm to about 1700 μm, still more preferably from about 100 μm to about 1500 μm, still more preferably from about 250 μm to about 1000 μm, most preferably from about 300 μm to about 800 μm, as measured according to the Median Particle Size Test described herein.

The bulk density of such discrete particles may range from 500 g/L to 1000 g/L, preferably from 600 g/L to 900 g/L, more preferably from 700 g/L to 800 g/L.

Like the non-fibrous sheets described hereinabove, the discrete particles of the present invention are also characterized by a sufficiently high surfactant content, e.g., at least 30%, preferably at least 50%, more preferably at least 60%, and most preferably at least 70%, by total weight of such discrete particles.

The second surfactant employed in the discrete particles can be selected from the group consisting of $C_6$-$C_{20}$ linear or branched alkylalkoxylated sulfates (AAS) having a weight average degree of alkoxylation ranging from 0.1 to 10, $C_6$-$C_{20}$ alkylalkoxylated alcohols (AA) having a weight average degree of alkoxylation ranging from 5 to 15, and combinations thereof. Such second surfactant may be present in each of the discrete particles in an amount ranging from 20% to 90%, preferably from 30% to 90%, more preferably from 40% to 90%, most preferably from 50% to 90%, by total weight of said each discrete particle.

Preferably, the second surfactant in the discrete particles of the present invention is a $C_6$-$C_{20}$ linear or branched AAS surfactant having a weight average degree of alkoxylation ranging from about 0.1 to about 10, preferably from about 0.1 to about 5. Particularly preferred is a $C_{10}$-$C_{16}$ linear or branched alkylethoxylated sulfate (AES) having a weight average degree of alkoxylation ranging from about 1 to about 5. Such AAS (preferably AES) surfactant can be used either alone or in combination with other surfactants. Preferably, the AAS (preferably AES) surfactant is used as a main surfactant in the discrete particles, i.e., it is present at an amount that is 50% or more by total weight of all surfactants in such particles, while one or more other surfactants (anionic, nonionic, amphoteric, and/or cationic) are present as co-surfactants for such AAS (or preferably AES).

Another preferred type of surfactants for use as the second surfactant in the discrete particles of the present invention are nonionic surfactants. Suitable nonionic surfactants include alkylalkoxylated alcohols, preferably alkylethoxylated alcohols and alkylethoxylated phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. In one example, the nonionic surfactant is selected from ethoxylated alcohols having an average of about 24 carbon atoms in the alcohol and an average degree of ethoxylation of about 9 moles of ethylene oxide per mole of alcohol. Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, BAE, wherein x is from 1 to 30; alkylpolysaccharides, and specifically alkylpolyglycosides; polyhydroxy fatty acid amides; and ether capped poly(oxyalkylated) alcohol surfactants. Suitable nonionic surfactants also include those sold under the tradename Lutensol® from BASF.

Particularly preferred nonionic surfactants for use as the second surfactant in the present invention are $C_6$-$C_{20}$ alkylalkoxylated alcohols (AA) having a weight average degree of alkoxylation ranging from 5 to 15, which may be present in the discrete particles either alone or in combination with the AAS or AES surfactant described hereinabove. AA can either be present as a main surfactant or as a co-surfactant for AAS or AES in the discrete particles. In a particularly preferred embodiment of the present invention, an AAS (preferably AES) surfactant is present as a main surfactant in the discrete particles, while an AA surfactant is present as a co-surfactant for such AAS or AES surfactant, for example, in a weight ratio ranging from 1:15 to 1:2, preferably from 1:10 to 1:3, and more preferably from 1:8 to 1:4.

In addition to the second surfactants of relatively high HI values (i.e., greater than 7.5) as mentioned hereinabove, the discrete particles of the present invention may comprise one or more additional surfactants selected from the group consisting of other anionic surfactants (i.e., other than AAS and AES), amphoteric surfactants, cationic surfactants, and combinations thereof, as described hereinabove for the non-fibrous sheet. Such additional surfactant(s) may be present in each of the discrete particles in an amount ranging from 0% to about 50%, preferably from 1% to 40%, more preferably from 2% to 30%, most preferably from 5% to 20%, by total weight of such each discrete particle. Preferably, such additional surfactant(s) are characterized by HI values that are lower than that of the second surfactant (i.e., no more than 7.5). For example, such additional surfactant (s) may an anionic surfactant selected from the group consisting of $C_6$-$C_{20}$ linear or branched LAS, $C_6$-$C_{20}$ linear or branched AS, $C_6$-$C_{20}$ linear or branched alkyl sulfonates, $C_6$-$C_{20}$ linear or branched alkyl carboxylates, $C_6$-$C_{20}$ linear or branched alkyl phosphates, $C_6$-$C_{20}$ linear or branched alkyl phosphonates, $C_6$-$C_{20}$ alkyl N-methyl glucose amides, $C_6$-$C_{20}$ methyl ester sulfonates (MES), and combinations thereof. Preferably, each of the discrete particles further comprises 0% to 50%, preferably from 0% to 30%, more preferably from 0% to 20%, most preferably from 0% to 15% of the first surfactant as mentioned hereinabove, by total weight of such each discrete particle.

The above-mentioned surfactant(s) forms a surfactant system, which can be present in an amount ranging from about 5% to about 90%, preferably from about 10% to about 90%, more preferably from about 20% to about 90%, still more preferably from about 30% to about 90%, and most preferably from about 50% to about 90%, by total weight of the discrete particles. Preferably, the second surfactant is present in the discrete particles as the main surfactant, i.e., it is present at an amount of 50% or more, by total weight of the surfactant system in the discrete particles.

In a particularly preferred embodiment of the present invention, the discrete particles contain AAS (or preferably AES) together with a functional rheology modifier that is selected from the group consisting of alkoxylated polyalkyleneimines and polyalkylene glycols. For example, the discrete particles may contain from about 0.5 wt % to about 20 wt %, preferably from about 1 wt % to about 15 wt %, and more preferably from about 2 wt % to about 10 wt % of an alkoxylated polyalkyleneimine and/or a polyalkylene glycol. Such rheology modifier functions to reduce the viscosity and persistence of sticky hexagonal phase formed by the AAS or AES surfactant during initial wetting of the discrete particles, thereby mitigating the risk of such discrete particles forming lump-gel on fabrics during wash, especially in cold-water or other stressed washing conditions.

Alkoxylated polyalkyleneimines, preferably alkoxylated polyethyleneimines, useful for practice of the present invention may contain a polyalkyleneimine backbone or core that is modified by replacing one or more hydrogen atoms attached to the nitrogen atoms in such backbone or core with polyoxyalkyleneoxy unit, i.e., $—(C_nH_{2n}O)_xH$, while n is an integer ranging from about 1 to about 10, preferably from about 1 to about 5, and more preferably from about 2 to about 4, and x is an integer ranging from 1 to 200, preferably from about 2 to about 100, and more preferably from about 5 to about 50. The polyalkyleneimine backbone or core typically has an average number-average molecular weight ($Mw_n$) prior to modification within the range of from about 100 to about 100,000, preferably from about 200 to about 5000, and more preferably from about 500 to about 1000. More preferably, the alkoxylated polyalkyleneimine of the present invention has a polyethyleneimine core with inner polyethylene oxide blocks and outer polypropylene oxide blocks. Specifically, such alkoxylated polyalkyleneimine has an empirical formula of $(PEI)_a(CH_2CH_2O)_b(CH_2CH_2CH_2O)_c$, while PEI stands for a polyethyleneimine core, while a is the average number-average molecular weight ($Mw_n$) prior to modification within the range of from about 100 to about 100,000 Daltons; b is the weight average number of ethylene oxide ($CH_2CH_2O$) units per nitrogen atom in the PEI core, which is an integer ranging from about 0 to about 60; and c is the weight average number of propylene oxide ($CH_2CH_2CH_2O$) units per nitrogen atom in the PEI core, which is an integer ranging from about 0 to about 60. Preferably, a ranges from about 200 to about 5000 Daltons, and more preferably from about 500 to about 1000 Daltons; preferably b ranges from about 1 to about 50, more preferably from about 5 to about 40, and most preferably from about 10 to about 30; and preferably c ranges from about 0 to about 40, more preferably from about 0 to about 30, and most preferably from about 0 to about 20. Preferred alkoxylated polyethyleneimine can be represented by an empirical formula of $(PEI)_{200-1000}(EO)_{15-25}$ or $(PEI)_{200-1000}(EO)_{20-30}(PO)_{10-30}$. Please note that the empirical formula shows only the relative amounts of each of the constituents, and is not intended to indicate the structural order of the different moieties.

Polyalkylene glycols, preferably polyethylene glycols (PEG), may be selected from poly(ethylene glycol) homopolymers and poly(ethylene glycol) copolymers having a weight average molecular weight of between about 200 and about 100,000 Daltons, preferably between about 500 and about 20,000 Daltons, more preferably from about 1000 to 15,000 Daltons, and most preferably from 2000 to 8000 Daltons. Suitable poly(ethylene glycol) copolymers preferably contain at least about 50 wt % of PEG and may be selected from the group consisting of poly(lactide-block-ethylene glycol), poly(glycolide-block-ethylene glycol), poly(lactide-co-caprolactone)-block-poly(ethylene glycol), poly(ethylene glycol-co-lactic acid), poly(ethylene glycol-co-glycolic acid), poly(ethylene glycol-co-poly(lactic acid-co-glycolic acid), poly(ethylene glycol-co-propylene glycol), poly(ethylene oxide-block-propylene oxide-block-ethylene oxide), poly(propylene oxide-block-ethylene glycol-block-propylene glycol), and poly(ethylene glycol-co-caprolactone). A particularly preferred PEG for use in the discrete particles is a poly(ethylene glycol) homopolymer having a weight average molecular weight of between about 4000 and about 8000 Daltons. Exemplary poly(ethylene glycol) homopolymers are commercially available from Sigma Aldrich, or from Dow under the tradename of CARBOWAX™, or from BASF under the tradename of Pluriol®. Exemplary poly(ethylene glycol) copolymers are commercially available from BASF under the tradenames of Pluronic® F127, Pluronic® F108, Pluronic® F68 and Pluronic® P105, Pluronic® F38, Pluronic® L92, and Pluronic® F77.

Another particularly preferred PEG for use in the discrete particles is an ethylene oxide-propylene oxide-ethylene oxide ($EOx_1POyEOx_2$) triblock copolymer, wherein each of $x_1$ and $x_2$ is in the range of about 2 to about 140, and wherein y is in the range of from about 15 to about 70. More preferably, such ethylene oxide-propylene oxide-ethylene oxide ($EOx_1POyEOx_2$) triblock copolymer has: (1) a weight average propylene oxide chain length of between 20 and 70, preferably between 30 and 60, more preferably between 45 and 55 propylene oxide units; and/or (2) a weight average molecular weight of between 1000 and 15,000, preferably between 1500 and 5000 more preferably between 2000 and 4500, even more preferably between 2500 and 4000, most preferably between 3500 and 3800 Daltons; and/or (3) a weight average ethylene oxide chain length of between 2 and 90, preferably 3 and 50, more preferably between 4 and 20 ethylene oxide units; and/or (4) between 10% and 90%, preferably between 15% and 50%, most preferably between 15% and 25% by weight of the triblock copolymer of the combined ethylene-oxide blocks. The total ethylene oxide content of such ethylene oxide-propylene oxide-ethylene oxide ($EOx_1POyEOx_2$) triblock copolymer can be equally split over the two ethylene oxide blocks, preferably each ethylene oxide block comprises on average between 40% and 60%, more preferably between 45% and 55%, even more preferably between 48% and 52%, most preferably 50% of the total number of ethylene oxide units, where the % of both ethylene oxide blocks adds up to 100%.

Preferably, the ethylene oxide-propylene oxide-ethylene oxide ($EOx_1POyEOx_2$) triblock copolymer has a molecular weight of between 1000 and 10,000, preferably between 1500 and 8000 more preferably between 2000 and 7500. Preferably, the copolymer comprises between 10% and 95%, preferably between 12% and 90%, most preferably between 15% and 85% by weight of the copolymer of the combined ethylene-oxide blocks. Some ethylene oxide-propylene oxide-ethylene oxide ($EOx_1POyEOx_2$) triblock copolymer improve dissolution.

Most preferably, the ethylene oxide-propylene oxide-ethylene oxide ($EOx_1POyEOx_2$) triblock copolymer has a molecular weight between 3500 and 3800, a propylene oxide content between 45 and 55 propylene oxide units, and an ethylene oxide content of between 4 and 20 ethylene oxide units per ethylene oxide block.

Suitable ethylene oxide-propylene oxide-ethylene oxide triblock copolymers are commercially available under the Pluronic PE series from the BASF company, or under the Tergitol L series from the Dow Chemical Company. A particularly suitable material is Pluronic® PE 9200.

The discrete particles of the present invention may optionally include one or more other adjunct detergent ingredients for assisting or enhancing cleaning performance or to modify the aesthetics thereof. Illustrative examples of such adjunct detergent ingredients include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylenepentamine); (4) polymeric dispersing agents, such as polymeric polycarboxylates, acrylic/maleic-based copolymers and water-soluble salts thereof of, hydroxypropylacrylate, maleic/acrylic/vinyl alcohol terpolymers, polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e.g., amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl) oxybenzenesulfonate, and mixtures thereof, benzoxazin-type activators, acyl lactam activators (especially acyl caprolactams and acyl valerolactams); and (14) any other known detergent adjunct ingredients, including but not limited to carriers, hydrotropes, processing aids, dyes or pigments (especially hueing dyes), perfumes (including both neat perfumes and perfume microcapsules), and solid fillers.

The process of making the discrete particles of the present invention, preferably in an agglomerated form, comprises the steps of: (a) adding powder and/or paste forms of raw ingredients into a mixer (e.g., a granulator), while the raw ingredients include the anionic surfactant(s), preferably in the form of a neutralized aqueous paste, and optionally recycling fines and/or ground-oversize materials from a previous granulation process; (b) running the mixer to provide a suitable shear force for agglomeration of the raw ingredients; (c) optionally, removing any oversize lumps and recycling via a grinder or lump-breaker to step (a) or (b); (d) the resulting agglomerates are dried to remove moisture that may be present in excess of 5 wt %, preferably in excess of 4%, more preferably in excess of 3%, and most preferably in excess of 2 wt %; (e) optionally, removing any fines and recycling the fines to the mixer-granulator, as described in step (a); and (f) optionally, further removing any dried oversize agglomerates and recycling via a grinder to step (a) or (e).

Alternatively, the discrete particles of the present invention can be made by a spray-drying process, a spray-drying process followed by granulation, an extrusion process, or any other process well known in the art to form particles.

Other Particles

In addition to the discrete, surfactant-containing particles described hereinabove, the unitary laundry detergent article of the present invention may further contain other particles sandwiched between the non-fibrous sheets. For example, such other particles may include soluble and/or insoluble material, where the insoluble material is dispersible in aqueous wash conditions to a suspension mean particle size that is less than about 20 microns.

The other particles may be a powder, granule, agglomerate, encapsulate, microcapsule, and/or prill. The other particles may be made using a number of well-known methods in the art, such as spray-drying, agglomeration, extrusion, prilling, encapsulation, pastillation and combinations thereof. The shape of the other particles can be in the form of spheres, rods, plates, tubes, squares, rectangles, discs, stars, fibers or have regular or irregular random forms.

The other particles may have a medium particle size, as measured according to the Median Particle Size Test described herein, of greater than about 150 μm and less than about 1600 μm, preferably greater than about 250 μm and less than about 1000 μm, more preferably greater than about 300 μm and less than about 850 μm, and most preferably greater than about 350 μm and less than about 700 μm.

The other particles may be any solid, free-flowing particles, and may include a mixture of chemically different particles, such as: surfactant particles (those substantially free of the second surfactant), including surfactant agglomerates, surfactant extrudates, surfactant needles, surfactant noodles, surfactant flakes; phosphate particles; zeolite particles; silicate salt particles, especially sodium silicate particles; carbonate salt particles, especially sodium carbonate particles; polymer particles such as carboxylate polymer particles, cellulosic polymer particles, starch particles, polyester particles, polyamine particles, terephthalate polymer particles, polyethylene glycol particles; aesthetic particles such as colored noodles, needles, lamellae particles and ring particles; enzyme particles such as protease granulates, amylase granulates, lipase granulates, cellulase granulates, mannanase granulates, pectate lyase granulates, xyloglucanase granulates, bleaching enzyme granulates and co-granulates of any of these enzymes, preferably these enzyme granulates comprise sodium sulphate; bleach particles, such as percarbonate particles, especially coated percarbonate particles, such as percarbonate coated with carbonate salt, sulphate salt, silicate salt, borosilicate salt, or any combination thereof, perborate particles, bleach activator particles such as tetra acetyl ethylene diamine particles and/or alkyl oxybenzene sulphonate particles, bleach catalyst particles such as transition metal catalyst particles, and/or isoquinolinium bleach catalyst particles, pre-formed peracid particles, especially coated pre-formed peracid particles; filler particles such as sulphate salt particles and chloride particles; clay particles such as montmorillonite particles and particles of clay and silicone; flocculant particles such as polyethylene oxide particles; wax particles such as wax agglomerates; silicone particles, brightener particles; dye transfer inhibition particles; dye fixative particles; perfume particles such as perfume microcapsules and starch encapsulated perfume accord particles, or pro-perfume particles such as Schiff base reaction product particles; hueing dye particles; chelant particles such as chelant agglomerates; and any combination thereof.

Unitary Laundry Detergent Article

The unitary laundry detergent article of the present invention contains the above-mentioned discrete particles, and optionally one or more other particles, which are sandwiched between two or more above-mentioned non-fibrous sheets. FIG. 1 is a schematic cross-sectional view of a unitary laundry detergent article 10, which contains multiple discrete, surfactant-containing particles 15 and optionally one or more other particles (not shown) sandwiched between two non-fibrous, surfactant-containing sheets 12 and 14. The discrete particles 12 and 14 and optionally the other particles (not shown) are free-flowing between the non-fibrous sheets 12 and 14 and are not immobilized by or fixed to any of these sheets.

Because both the discrete particles and the non-fibrous sheets contain surfactants, the unitary laundry detergent article of the present invention is characterized by a significantly high surfactant content, e.g., at least 30%, preferably at least 50%, more preferably at least 60%, and most preferably at least 70%, by total weight of such article. Such a laundry detergent article provides a very compact and concentrated form of laundry detergent, which is particularly convenient for consumers who travel often and need to do laundry on the road. Further, shipping and handling costs for such compact and concentrated form are significantly reduced, in comparison with the traditional powder or liquid forms of laundry detergents, which make this unitary laundry detergent article particularly desirable to be marketed through e-commerce channels.

Further, because the discrete particles and the non-fibrous sheets contain different surfactants of different hydrophilicity, the resulting laundry detergent article exhibit superior cleaning performance adapted to various washing conditions.

More importantly, the different surfactants are arranged in such laundry detergent article in such a manner as to improve cleaning performance, ensure processing stability, reduce gel-formation, and maintain fast dissolution of the article, as described hereinabove. Preferably, the unitary laundry detergent article has a Percentage (%) Dissolved of more than about 50%, preferably more than about 60%, more preferably more than about 70%, most preferably more than about 90%, within 15 minutes of washing. More preferably, such laundry detergent article has a Percentage (%) Dissolved of more than about 50% within 5 minutes of washing.

The unitary laundry detergent article of the present invention can have any shape or size, and it is preferably a laminar article having: (1) a thickness ranging from about 0.1 mm to about 10 mm, (2) a length-to-thickness aspect ratio of at least about 5:1, and (3) a width-to-thickness aspect ratio of at least about 5:1. Further, it is preferred that the unitary laundry detergent article has a length-to-width aspect ratio of at least about 1:1. Preferably, the length-to-thickness aspect ratio and the width-to-thickness aspect ratio are both at least about 10:1, and the length-to-width aspect ratio is at least about 1.2:1. More preferably, the length-to-thickness aspect ratio and the width-to-thickness aspect ratio are both at least about 15:1, and the length-to-width aspect ratio is at least about 1.5:1. Most preferably, the length-to-thickness aspect ratio and the width-to-thickness aspect ratio are both at least about 20:1, and the length-to-width aspect ratio is at least about 1.618:1. The thickness of the unitary laundry detergent article of the present invention is preferably from about 0.2 mm to about 5 mm, more preferably from about 0.3 mm to about 4 mm, and most preferably from about 0.5 mm to about 2 mm. The width of such article may range from about 2 cm to about 1 meter, preferably from about 5 cm to about 50 cm, more preferably from about 10 cm to about 40 cm. The length of such article may range from about 2 cm to about 50 meters, preferably from about 5 cm to about 1 meter, and more preferably from about 10 cm to about 80 cm.

In a preferred but not necessary embodiment of the present invention, the unitary laundry detergent article of the present invention has a golden rectangular shape (i.e., with a length-to-width aspect ratio of about 1.618:1), and it is characterized by a width of about 10-15 cm and a thickness of about 0.5 mm to about 2 mm. Such a golden rectangular shape is aesthetically pleasing and delightful to the consumers, so multiple articles of such shape can be stacked up and packaged together for sale in a container that is also characterized by a similar golden rectangular shape.

In an alternative embodiment of the present invention, the unitary laundry detergent article has an elongated shape (i.e., with a length-to-width aspect ratio of about 10-50:1), and it is characterized by a width of about 10-15 cm and a thickness of about 0.5 mm to about 2 mm. Such elongated shape allows such an article to be rolled up or folded into a compact unit for easy of packaging, storage, shipment and display.

Preferably, the unitary laundry detergent article of the present invention has certain attributes that render it aesthetically pleasing to the consumers. For example, the article may have a relatively smooth surface, thereby providing a pleasant feel when touched by the consumer. Further, it is desirable that such article may have little or no perceivable pores on its surface. It is also desirable that the unitary laundry detergent article of the present invention is strong to withstand substantive mechanical forces without losing its structural integrity, yet at the same time is sufficiently flexible for ease of packaging and storage.

Preferably, the unitary laundry detergent article can be completely dissolved in a liter of deionized water, i.e., leaving no visible residue in the solution, within 15 seconds, more preferably within 10 seconds, and more preferably within 5 seconds, at 20° C. under atmospheric pressure and without any stirring.

The unitary laundry detergent article can be formed by first forming the non-fibrous sheets and the discrete particles (and optionally one or more other particles) separately, as described hereinabove, and then assembling them together into a unitary article. For example, a first already-formed non-fibrous sheet can be placed on a flat surface, e.g., a conveyor belt, while already-formed discrete particles (and optionally one or more other particles) can be deposited onto a first planar surface of the first non-fibrous sheet. The discrete particles (and optionally one or more other particles) can be simply scattered over such upper surface of the first non-fibrous sheet, or they can form a continuous layer of particles on the first planar surface of the first non-fibrous sheet. Subsequently, a second already-formed non-fibrous sheet is placed on top of the first planar surface of the first non-fibrous sheet, to form a sandwich structure with the discrete particles (and optionally one or more other particles) disposed between the first and second non-fibrous sheets.

Figure 2:
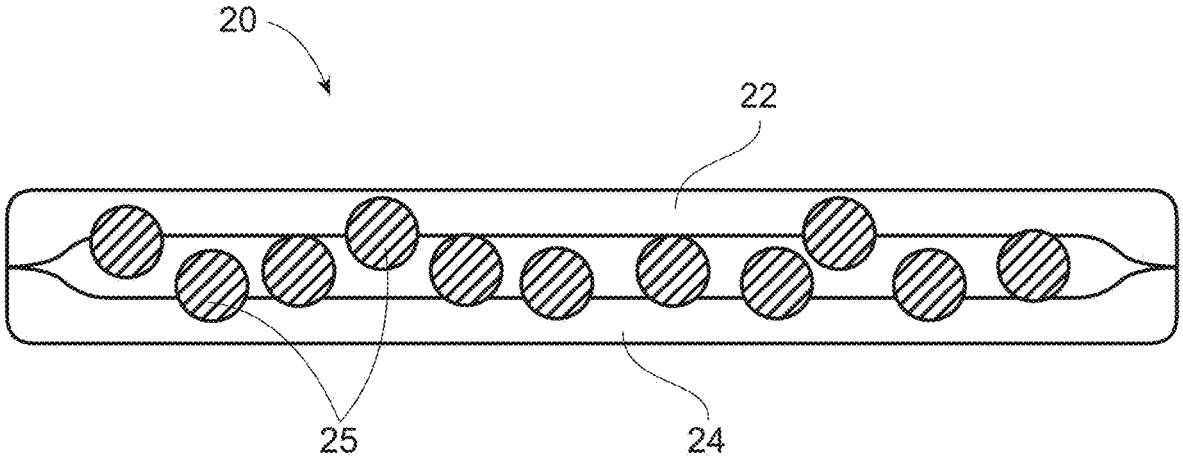
FIG. 2 is a schematic cross-sectional view of a unitary laundry detergent article comprising discrete, surfactant-containing particles sandwiched between two non-fibrous, surfactant-containing sheets, while the particles are partially embedded in the two sheets and therefore immobilized, according to one embodiment of the present invention.

Alternatively, the unitary laundry detergent article can be formed by simultaneously forming and assembling the non-fibrous sheets and the discrete particles (and optionally one or more other particles) together into a unitary article. In such an embodiment, the discrete particles (and optionally one or more other particles) can be disposed onto one or more non-fibrous sheets as those sheets are being formed or dried, so that the discrete particles (and optionally one or more other particles) are at least partially embedded into such sheets (some particles may even become completely embedded into the sheets) and become immobilized therein. FIG. 2 is a schematic cross-sectional view of a unitary laundry detergent article 20 so formed, which contains multiple discrete, surfactant-containing particles 25 and optionally other particles (not shown) sandwiched between two non-fibrous, surfactant-containing sheets 22 and 24. The discrete particles 25 and optionally other particles (not shown) are partially embedded in the two sheets and therefore immobilized. Such immobilized discrete particles 25 have a reduced risk of leaking out of the unitary laundry detergent article 20 and are therefore particularly preferred, although free-flowing discrete particles not so immobilized are also within the scope and spirit of the present invention.

Figure 3:
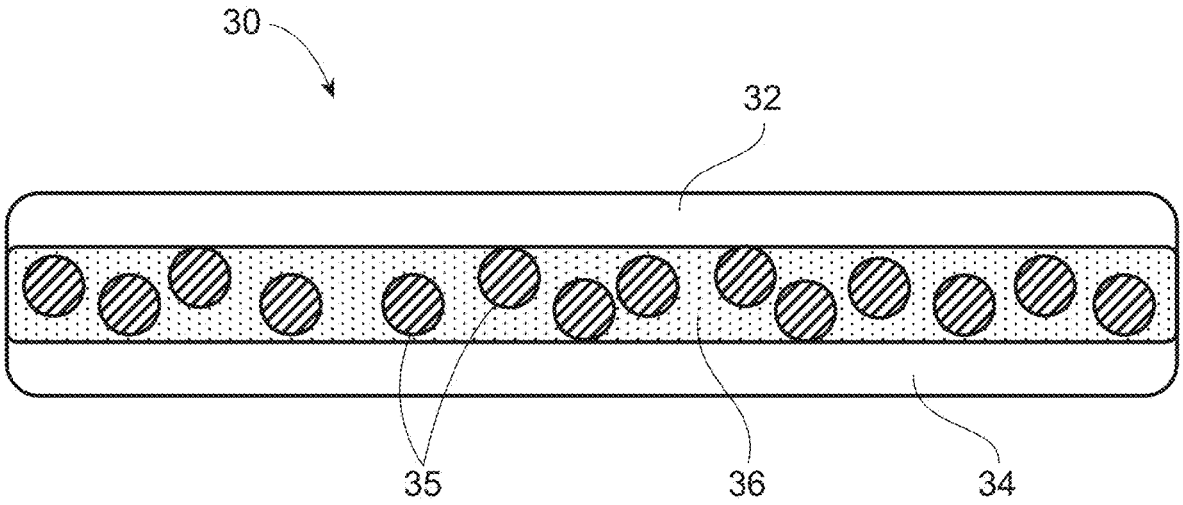
FIG. 3 is a schematic cross-sectional view of a unitary laundry detergent article comprising discrete, surfactant-containing particles that are fully embedded in a non-fibrous, surfactant-containing sheet, which is in turn sandwiched between two additional non-fibrous, surfactant-containing sheets, according to one embodiment of the present invention.
Figure 4:
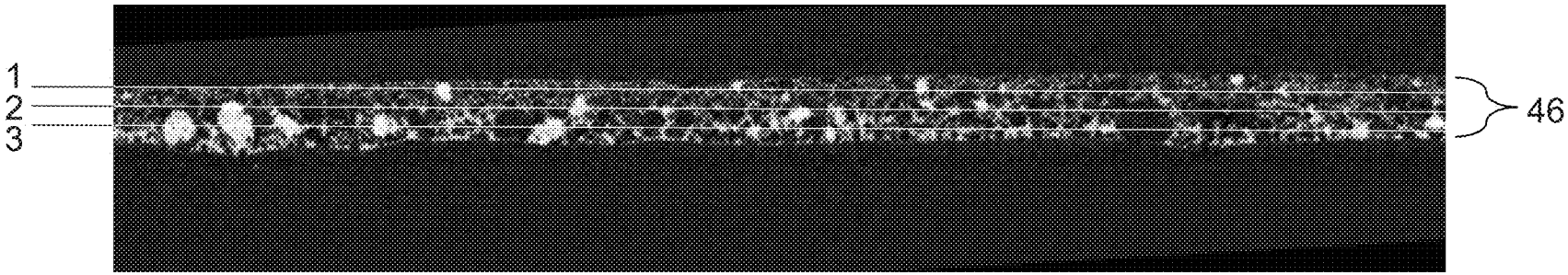
FIG. 4 is an X-ray computed tomography (CT) cross-sectional view of a non-fibrous, surfactant-containing sheet according to one embodiment of the present invention, which shows discrete, surfactant-containing particles fully embedded therein.
Figure 5A:
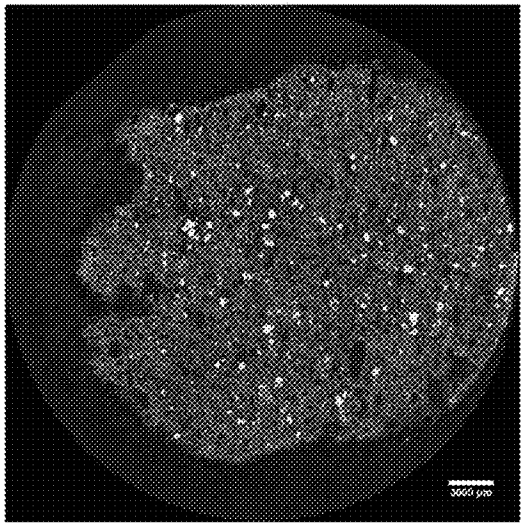
FIGS. 5A-5C are X-ray CT topographic pictures of the sheet of FIG. 4 from Positions 1, 2, 3 of FIG. 4, respectively.
Figure 5B:
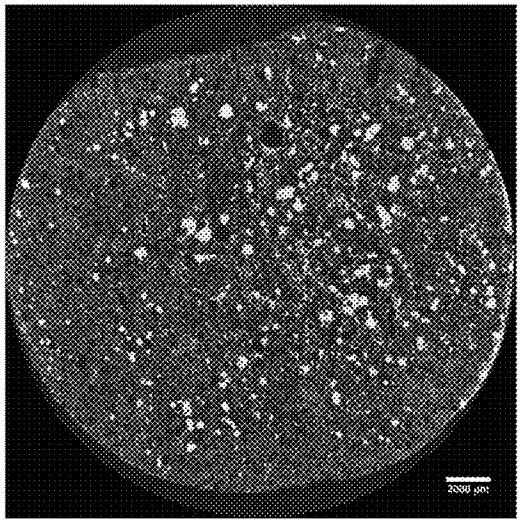
Figure 5C:
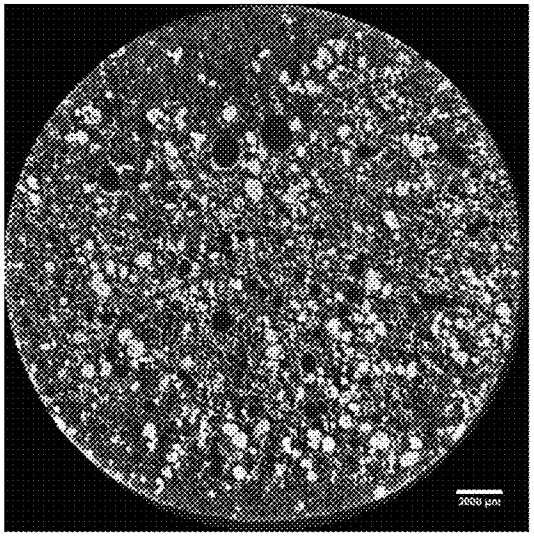

Further, the discrete particles (and optionally one or more other particles) can be incorporated onto one or more non-fibrous sheets, which in turn are sandwiched between additional non-fibrous sheets, so that the discrete particles (and optionally one or more other particles) are fully embedded into the sheets and become immobilized therein. FIG. 3 is a schematic cross-sectional view of a unitary laundry detergent article 30 comprising multiple discrete, surfactant-containing particles 35 and optionally one or more other particles (not shown) that are fully embedded in a non-fibrous, surfactant-containing sheet 36, which is in turn sandwiched between two additional non-fibrous, surfactant-containing sheets 32 and 34. FIGS. 4 and 5A-5C show an actual non-fibrous, surfactant-containing sheet with discrete particles fully embedded therein. Specifically, FIG. 4 is an X-ray CT cross-sectional view of a non-fibrous, surfactant-containing sheet as taken by GE Phoenix v|tome|x m CT scanner. The sheet contains visibly discrete particles fully embedded therein. FIGS. 5A-5C are X-ray CT topographic pictures of the sheet of FIG. 4 from Positions 1, 2 and 3 of FIG. 4, respectively, which clearly show multiple visibly discrete, white particles distributed throughout such sheet.

The unitary laundry detergent article of the present invention may comprise any number of additional layers of discrete particles and additional non-fibrous sheets as desired. For example, it is possible to turn the above-described sandwich structure over to deposit additional discrete particles onto an opposite, second planar surface of the first non-fibrous sheet, and then place a third already-formed non-fibrous sheet on top of the second planar surface of the first non-fibrous sheet, thereby forming a unitary laundry detergent article containing three non-fibrous sheets with two layers of discrete particles sandwiched therebetween.

In a particularly preferred embodiment of the present invention, the unitary laundry detergent article of the present invention may also contain one or more additional non-fibrous sheets, which is disposed in proximity to at least one of said non-fibrous sheets. Like the non-fibrous sheets and the discrete particles, such additional non-fibrous sheets are also water-soluble. Each of the additional non-fibrous sheets preferably contains from 10% to 90%, preferably from 20% to 80%, more preferably from 30% to 70% of a third surfactant, by total dry weight of such each additional non-fibrous sheet. The third surfactant can be either the same as the first or second surfactant as mentioned hereinabove, or it can be different. Preferably, the third surfactant is the same as the first surfactant. Such additional non-fibrous sheets can be disposed between the non-fibrous sheets, for example, adjacent to the discrete particles (i.e., one layer of discrete particles adjacent to one fibrous sheet), or being impregnated with the discrete particles (i.e., the discrete particles and fibrous sheet form a unitary structure together), or between two layers of discrete particles (i.e., one fibrous sheet sandwiched between two layers of discrete particles).

Further, the unitary laundry detergent article of the present invention may also contain one or more fibrous sheets, which is disposed in proximity to at least one of said non-fibrous sheets. Like the non-fibrous sheets and the discrete particles, such fibrous sheets are also water-soluble. Each of the fibrous sheets preferably contains a plurality of filaments, each of which preferably comprises from 10% to 90%, preferably from 20% to 80%, more preferably from 30% to 70% of a fourth surfactant, by total dry weight of such each filament. The fourth surfactant can be either the same as the first, second, or third surfactant as mentioned hereinabove, or it can be different. Preferably, the fourth surfactant is the same as the first surfactant. Such fibrous sheets can be disposed between the non-fibrous sheets, for example, adjacent to the discrete particles (i.e., one layer of discrete particles adjacent to one fibrous sheet), or being impregnated with the discrete particles (i.e., the discrete particles and fibrous sheet form a unitary structure together), or between two layers of discrete particles (i.e., one fibrous sheet sandwiched between two layers of discrete particles).

Figure 6:
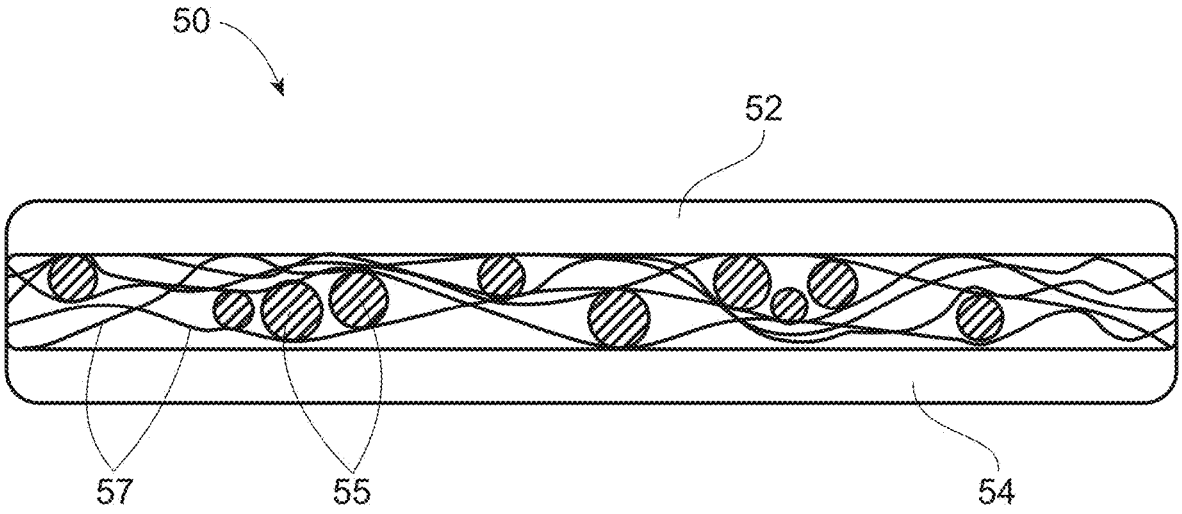
FIG. 6 is a schematic cross-sectional view of a unitary laundry detergent article comprising discrete, surfactant-containing particles that are fully embedded in a fibrous, surfactant-containing sheet comprising a plurality of filaments, while such fibrous sheet is in turn sandwiched between two non-fibrous, surfactant-containing sheets, according to one embodiment of the present invention.

FIG. 6 is a schematic cross-sectional view of a unitary laundry detergent article 50 comprising multiple discrete, surfactant-containing particles 55 and optionally one or more other particles (not shown) that are fully embedded in a fibrous, surfactant-containing sheet 56 comprising a plurality of filaments 57. Such fibrous sheet 56 is in turn sandwiched between two non-fibrous, surfactant-containing sheets 52 and 54, according to one embodiment of the present invention.

The unitary laundry detergent article so formed can be further processed by heat-pressing or heat-sealing, either along the periphery thereof, or over the entire article, or intermittently at certain sections or regions of such articles, so as to enhance its structural integrity. Still further, the unitary laundry detergent article can be cut into different shapes, embossed, perforated, printed with different colors or graphic patterns, folded, rolled-up, or otherwise packaged in order to improve its aesthetic appeal and user-friendliness.

Correspondingly, the unitary laundry detergent article as mentioned hereinabove can be readily used for pre-treating and/or cleaning fabrics, especially for removing stains and/or odors from fabrics. Preferably, the unitary laundry detergent article of the present invention as mentioned hereinabove is used for pre-treating fabrics before cleaning, which is particularly effective in removing tough stains, such as collar soil, food grease, grass stains, clay or other hard-to-remove soil or dirt. When used for pre-treating and/or cleaning, a section of the fabrics in need of pre-treating and/or cleaning can be first wetted, and then such unitary laundry detergent article, or a piece thereof, can be directly contacted with the wetted section of the fabrics.

Measurement Methods

Various techniques are known in the art to determine properties of the unitary laundry detergent article of the present invention or components thereof. However, the following assays must be used in order that the invention described and claimed herein may be fully understood.

Test 1: Median Particle Size Test Method

This test method must be used to determine median particle size of the discrete particles as mentioned hereinabove.

The median particle size test is conducted to determine the median particle size of the seed material using ASTM D 502-89, "Standard Test Method for Particle Size of Soaps and Other Detergents", approved May 26, 1989, with a further specification for sieve sizes used in the analysis. Following section 7, "Procedure using machine-sieving method," a nest of clean dry sieves containing U.S. Standard (ASTM E 11) sieves #8 (2360 um), #12 (1700 um), #16 (1180 um), #20 (850 um), #30 (600 um), #40 (425 um), #50 (300 um), #70 (212 um), #100 (150 um) is required. The prescribed Machine-Sieving Method is used with the above sieve nest. The seed material is used as the sample. A suitable sieve-shaking machine can be obtained from W.S. Tyler Company of Mentor, Ohio, U.S.A.

The data are plotted on a semi-log plot with the micron size opening of each sieve plotted against the logarithmic abscissa and the cumulative mass percent ($Q_3$) plotted against the linear ordinate. An example of the above data representation is given in ISO 9276-1:1998, "Representation of results of particle size analysis—Part 1: Graphical Representation", Figure A.4. The seed material median particle size ($D_{50}$), for the purpose of this invention, is defined as the abscissa value at the point where the cumulative mass percent is equal to 50 percent, and is calculated by a straight line interpolation between the data points directly above (a50) and below (b50) the 50% value using the following equation:

$$D_{50}=10\hat{}[\mathrm{Log}(D_{a50})-(\mathrm{Log}(D_{a50})-\mathrm{Log}(D_{b50}))*(Q_{a50}-50\%)/(Q_{a50}-Q_{b50})]$$

where $Q_{a50}$ and $Q_{b50}$ are the cumulative mass percentile values of the data immediately above and below the $50^{th}$ percentile, respectively; and $D_{a50}$ and $D_{b50}$ are the micron sieve size values corresponding to these data.

In the event that the $50^{th}$ percentile value falls below the finest sieve size (150 μm) or above the coarsest sieve size (2360 μm), then additional sieves must be added to the nest following a geometric progression of not greater than 1.5, until the median falls between two measured sieve sizes.

The Distribution Span of the Seed Material is a measure of the breadth of the seed size distribution about the median. It is calculated according to the following:

$$\mathrm{Span}=(D_{84}/D_{50}+D_{50}/D_{16})/2$$

where $D_{50}$ is the median particle size and $D_{84}$ and $D_{16}$ are the particle sizes at the sixteenth and eighty-fourth percentiles on the cumulative mass percent retained plot, respectively.

In the event that the $D_{16}$ value falls below the finest sieve size (150 μm), then the span is calculated according to the following:

$$\mathrm{Span}=(D_{84}/D_{50}).$$

In the event that the $D_{84}$ value falls above the coarsest sieve size (2360 μm), then the span is calculated according to the following:

$$\mathrm{Span}=(D_{50}/D_{16}).$$

In the event that the $D_{16}$ value falls below the finest sieve size (150 μm) and the $D_{84}$ value falls above the coarsest sieve size (2360 μm), then the distribution span is taken to be a maximum value of 5.7.

Test 2: Water Content Test Method

The water (moisture) content present in a particle and/or substrate structure is measured using the following Water Content Test Method. A particle and/or substrate structure or portion thereof ("sample") in the form of a pre-cut sheet is placed in a conditioned room at a temperature of 23° C.±1.0° C. and a relative humidity of 50%±2% for at least 24 hours prior to testing. Each structure sample has an area of at least 4 square inches, but small enough in size to fit appropriately on the balance weighing plate. Under the temperature and humidity conditions mentioned above, using a balance with at least four decimal places, the weight of the sample is recorded every five minutes until a change of less than 0.5% of previous weight is detected during a 10-minute period. The final weight is recorded as the "equilibrium weight". Within 10 minutes, the samples are placed into the forced air oven on top of foil for 24 hours at 70° C.±2° C. at a relative humidity of 4%±2% for drying. After the 24 hours of drying, the sample is removed and weighed within 15 seconds. This weight is designated as the "dry weight" of the sample.

The water (moisture) content of the sample is calculated as follows:

$$\%\ \text{Water in sample} = 100\% \times \frac{\left(\text{Equilibrium weight of sample} - \text{Dry weight of sample}\right)}{\text{Dry weight of sample}}$$

The % Water (moisture) in sample for 3 replicates is averaged to give the reported % Water (moisture) in sample. Report results to the nearest 0.1%.

Test 3: Black Cotton Pouch Dissolution Test

An Electrolux W565H programmable front-loading washing machine is programed to perform the following steps for each wash cycle with a respective total washing time (e.g., 1, 5, 10, or 15 minutes):

| Step | Action |
|---|---|
| 1 | Add 20 kg of reverse osmosis purified water, and the water temperature is maintained at 20° C. throughout the wash cycle |
| 2 | Accelerate the drum to 45 revolutions per minute in the clockwise direction over 2 seconds with a linear rate of acceleration |
| 3 | Maintain the drum rotation speed at 45 revolutions per minute for 22 seconds |
| 4 | Decelerate the drum to 0 revolutions per minute over 2 seconds with a linear rate of deceleration |
| 5 | Drum remains stationary for 4 seconds |
| 6 | Repeat steps 2-5 but with drum rotating in the counter-clock direction |
| 7 | Repeat steps 2-6 until the respective total washing time is reached |

For each sample unitary laundry detergent article, the following steps are performed:

Two (2) sample unitary laundry detergent articles are first weighted (with a combine weight of approximately 11.5 g), and the total weight is recorded as the "Total Weight of Sample Material";

Each sample unitary laundry detergent article is then inserted into a black cotton pouch having dimensions of approximately 8 $cm^2$, which consists of two (2) layers of 100% cotton fabric with three sides already sealed by stitching and the fourth side left open for inserting the article. Once the article is inserted, the black cotton pouch is then sealed by punching three (3) staples through the two layers;

The two (2) black cotton pouch each containing a sample unitary laundry detergent article are then added into the above-mentioned washing machine, together with two (2) kilograms of 100% cotton terry towels, each of which has a square shape of approximately 20×20 $cm^2$;

The black cotton pouch and the cotton terry towels undergo one wash cycle as described hereinabove, with a predetermined total washing time (e.g., 1, 5, 10, or 15 minutes);

At the end of each wash cycle, the two black cotton pouches are taken out of the washing machine and opened, while any undissolved residue of the sample articles is removed from the black cotton pouches by using a laboratory spatula and then transferred to a plastic pot;

The undissolved residue is left for air dry at room temperature in the plastic pot for 24 hours;

The air-dried residue is then weighted, and the weight is recorded as the "Weight of Undissolved Solids";

The Percentage (%) Dissolved of the sample material can then be calculated as $$\frac{\text{Total Weight of Sample Material} - \text{Weight of Undissolved Solids}}{\text{Total Weight of Sample Material}} \times 100\%.$$

The above steps are repeated for each type of unitary laundry detergent article, while the total washing time of the wash cycle varies, e.g., from 1 minute, to 5 minutes, to 10 minutes, and finally to 15 minutes.

EXAMPLES

Example 1: Non-Fibrous Sheet Formulations

| Ingredients (wt %) | General | S1 | S2 | S3 | S4 |
|---|---|---|---|---|---|
| $C_{12}$-$C_{14}$ AS | 40-70% | 60% | 70% | 45% | 50% |
| $C_{12}$-$C_{14}$ LAS | 5-20% | 10% | — | — | — |
| $C_{12}$-$C_{14}$ AES* | 0-5% | — | — | — | — |
| $C_{16}$-$C_{18}$ MES | 0-30% | — | — | 20% | 20% |
| $C_{12}$-$C_{18}$ PKO CAB | 0-8% | — | — | 5% | — |
| PVA** | 15-25% | 20% | 20% | 20% | 20% |
| PEG*** | 0-8% | 5% | — | — | — |
| Glycerin | 1-5% | 4% | 6% | 6% | 6% |
| Misc. & Moisture | 2-10% | Balance | Balance | Balance | Balance |

*Having an average ethoxylation degree of about 1

**Having a weight average molecular weight (Mw) of about 48000 Daltons.

***Having a weight average molecular weight (Mw) of about 4000 Daltons.

Example 2: Discrete Particle Formulations

| Ingredients (wt %) | P1 | P2 | P3 | P4 | P5 | P6 |
|---|---|---|---|---|---|---|
| $C_{12}$-$C_{14}$ LAS | 9.47% | 10.48% | 15% | — | 70% | — |
| $C_{12}$-$C_{14}$ AES* | 21.58% | 21% | 45% | 45% | — | — |
| $C_{12}$-$C_{15}$ AA** | — | — | — | — | — | 57% |
| Ethoxylated PEI*** | 3.65% | 2.11% | — | — | — | — |
| PEG**** | 8.22% | — | — | — | — | — |
| Soda ash | 15.29% | 10.55% | 7% | 35% | — | 18% |
| Zeolite | 31.97% | 44.16% | — | — | — | — |
| Silica | — | — | 18% | 15% | 22% | 25% |
| Misc. & Moisture | Balance | Balance | balance | Balance | Balance | balance |

*Having an average ethoxylation degree of about 1

**Having a weight average degree of alkoxylation of about 7

***$PEI_{600}EO_{20}$

****Having a weight average molecular weight of about 4000 Daltons

Example 3: Dissolution of Inventive Unitary Laundry Detergent Articles

Five (5) samples of inventive unitary laundry detergent articles are provided, each of which contains two non-fibrous sheets S1 as described in Example 1, with different discrete particles as described in Example 2, enzyme particles and perfume microcapsule (PMC) particles sandwiched therebetween. Each of the non-fibrous sheets S1 has a length of about 5.5 cm, a width of about 5.5 cm, and a thickness of about 5 mm, and weighs about 1.5 grams, so the total weight of the non-fibrous sheets is about 3 grams. The discrete particles have an average particle size of about 400 microns. The total weight of various particles incorporated into each unitary laundry detergent articles is about 9 grams.

Each of the sample inventive unitary laundry detergent article is subjected to the Black Cotton Pouch Dissolution Test as mentioned hereinabove, and their respective Percentage (%) Dissolved after washing for 1 minute, 5 minutes, 10 minutes, and 15 minutes respectively is as follows:

| Inventive Unitary Laundry Detergent Article | Percentage (%) Dissolved | | | |
|---|---|---|---|---|
| | 1 min. | 5 min. | 10 min. | 15 min. |
| S1 (25%) + P2 (72%) + Enzyme (1.5%) + PMC (1.5%) | 19.9 | 55.9 | 84.4 | 99.62 |
| S1 (25%) + P3 (72%) + Enzyme (1.5%) + PMC (1.5%) | −14.9 | 25.7 | 42.5 | 62.6 |
| S1 (25%) + P5 (12%) + P6 (60%) | −32.2 | 32.9 | 72.0 | 77.5 |
| S1 (25%) + P4 (60%) + P6 (12%) + Enzyme (1.5%) + PMC (1.5%) | −13.6 | 49.1 | 74.8 | 90.2 |
| S1 (25%) + P4 (52%) + P5 (8%) + P6 (12%) + Enzyme (1.5%) + PMC (1.5%) | −28.3 | 7.7 | 48.4 | 61.8 |

Based on the fore-going, it is evident that all inventive unitary laundry detergent articles can achieve at least 50% dissolution within 15 minutes in a wash cycle under cold water washing conditions, while some preferred samples can achieve 50% dissolution within 5 minutes and more than 90% dissolution within 15 minutes.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unitary laundry detergent article comprising two or more non-fibrous sheets and one or more discrete particles disposed between said two or more non-fibrous sheets, wherein both said non-fibrous sheets and said discrete particles are water-soluble; wherein each of said non fibrous sheets comprises at least one film former and a first surfactant, wherein said first surfactant is characterized by a Hydrophilic Index (HI) of no more than 6.98; wherein each of said discrete particles comprises a second surfactant, wherein said second surfactant is characterized by a HI of greater than 7.5; wherein the discrete particles are sandwiched between said two or more non-fibrous sheets.

2. The unitary laundry detergent article of claim 1, wherein the first surfactant is selected from the group consisting of unalkoxylated $C_6$-$C_{20}$ linear or branched alkyl sulfates (AS), $C_6$-$C_{20}$ linear alkylbenzene sulfonates (LAS), and combinations thereof.

3. The unitary laundry detergent article of claim 2, wherein the first surfactant is present as the main surfactant in each of the non-fibrous sheets, and wherein the second surfactant is present as the main surfactant in each of the discrete particles.

4. The unitary laundry detergent article of claim 1, wherein each of said non-fibrous sheets has a thickness ranging from 0.1 mm to 10 mm, a length-to-thickness aspect ratio of at least 5:1, and a width-to-thickness aspect ratio of at least 5:1; wherein said discrete particles are characterized by a median particle size ranging from 1 μm to 2000 μm; and wherein said discrete particles are at least partially embedded into at least one of said non-fibrous sheets.

5. The unitary laundry detergent article of claim 1, wherein each of the non-fibrous sheets contains: (1) from 5% to 90 of said first surfactant, by total weight of said each non-fibrous sheet; and (2) from 1% to 70% of said at least one film former, by total weight of said each non-fibrous sheet.

6. The unitary laundry detergent article of claim 1, wherein the first surfactant in the non-fibrous sheets is an unalkoxylated $C_6$-$C_{18}$ linear or branched AS surfactant.

7. The unitary laundry detergent article of claim 1, wherein said at least one film former in the non-fibrous sheets is a water-soluble polymer, which is selected from the group consisting of polyvinyl alcohols, polyalkylene glycols, starch or modified starch, cellulose or modified cellulose, polyacrylates, polymethacrylates, polyacrylamides, polyvinylpyrrolidones, and combinations thereof.

8. The unitary laundry detergent article of claim 1, wherein said at least one film former is a polyvinyl alcohol characterized by: (1) a weight average molecular weight ranging from 10,000 to 140,000 Daltons; and/or (2) a degree of hydrolysis ranging from 40% to 100%.

9. The unitary laundry article of claim 1, wherein each of said non-fibrous sheets comprises from 1% to 15% of the second surfactant, by total weight of said each non-fibrous sheet.

10. The unitary laundry detergent article of claim 1, wherein each of said discrete particles comprises from 20% to 90% of said second surfactant, by total weight of said each discrete particle.

11. The unitary laundry detergent article of claim 1, wherein the second surfactant is a $C_6$-$C_{20}$ linear or branched AAS surfactant having a weight average degree of alkoxylation ranging from 0.1 to 10.

12. The unitary laundry detergent article of claim 11, wherein each of said discrete particles further comprises from 0.5% to 20% of an alkoxylated polyalkyleneimine, by total weight of said each discrete particle, wherein said alkoxylated polyalkyleneimine has an empirical formula of $(PEI)_a(CH_2CH_2O)_b(CH_2CH_2CH_2O)_c$, wherein PEI is a polyethyleneimine core; wherein a is the number average molecular weight (MW) of the PEI core prior to modification, which ranges from 100 to 100,000 Daltons, wherein b is the weight average number of ethylene oxide ($CH_2CH_2O$)

units per nitrogen atom in the PEI core, which ranges from 0 to 60; and wherein c is the weight average number of propylene oxide ($CH_2CH_2CH_2O$) units per nitrogen atom in the PEI core, which ranges from 0 to 60.

13. The unitary laundry detergent article of claim 11, wherein each of said discrete particle further comprises 0.5% to 20% of a polyalkylene glycol, by total weight of said each discrete particle, wherein said polyalkylene glycol is a polyethylene glycol with a weight average molecular weight ranging from 500 to 20,000 Daltons.

14. The unitary detergent article of claim 1, further comprising one or more fibrous sheets disposed in proximity to at least one of said non-fibrous sheets, wherein said one or more fibrous sheets are water-soluble, wherein each of said one or more fibrous sheets comprises a plurality of filaments, and wherein each filament comprises from 10% to 90% of a third surfactant, by total dry weight of said each filament.

15. The unitary laundry detergent article of claim 1, further comprising one or more additional non-fibrous sheets disposed in proximity to at least one of said non-fibrous sheets, wherein said one or more additional non-fibrous sheets are water-soluble, wherein each of said one or more additional non-fibrous sheets comprises from 10% to 90% of a fourth surfactant, by total dry weight of said each additional non-fibrous sheet.

* * * * *